US008466867B2

(12) United States Patent
Jarupoonphol et al.

(10) Patent No.: US 8,466,867 B2
(45) Date of Patent: Jun. 18, 2013

(54) LIQUID CRYSTAL DISPLAY DEVICE WITH COMMON CONNECTION LINE VOLTAGE ADJUSTED IN A HOLDING PERIOD FOR AN IMPROVED PERFORMANCE

(75) Inventors: Werapong Jarupoonphol, Kanagawa (JP); Takeya Takeuchi, Aichi (JP); Tomohiko Sato, Kanagawa (JP)

(73) Assignee: Japan Display West Inc., Aichi (JP)

( * ) Notice: Subject to any disclaimer, the term of this patent is extended or adjusted under 35 U.S.C. 154(b) by 286 days.

(21) Appl. No.: 12/828,432

(22) Filed: Jul. 1, 2010

(65) Prior Publication Data

US 2011/0007060 A1 Jan. 13, 2011

(30) Foreign Application Priority Data

Jul. 9, 2009 (JP) ..... 2009-163134

(51) Int. Cl.
*G09G 3/36* (2006.01)

(52) U.S. Cl.
USPC ..... 345/95

(58) Field of Classification Search
USPC ..... 345/95, 96
See application file for complete search history.

(56) References Cited

U.S. PATENT DOCUMENTS

| | | | | |
|---|---|---|---|---|
| 4,746,196 | A * | 5/1988 | Umeda et al. | 349/34 |
| 6,005,543 | A * | 12/1999 | Kimura | 345/94 |
| 6,084,562 | A * | 7/2000 | Onda | 345/94 |
| 6,414,729 | B1 | 7/2002 | Akiyama et al. | |
| 6,559,824 | B1 | 5/2003 | Kubota et al. | |
| 2003/0011555 | A1 * | 1/2003 | Fukami et al. | 345/94 |
| 2003/0160775 | A1 * | 8/2003 | Kumada et al. | 345/209 |
| 2004/0164943 | A1 * | 8/2004 | Ogawa et al. | 345/92 |
| 2005/0140633 | A1 * | 6/2005 | Kato | 345/96 |
| 2005/0253829 | A1 * | 11/2005 | Mamba et al. | 345/204 |
| 2006/0145993 | A1 * | 7/2006 | Kitaoka | 345/94 |
| 2007/0159574 | A1 * | 7/2007 | Burberry et al. | 349/74 |
| 2009/0040162 | A1 * | 2/2009 | Watanabe et al. | 345/96 |

FOREIGN PATENT DOCUMENTS

| | | | |
|---|---|---|---|
| JP | 11-721787 | | 10/1999 |
| JP | 11271787 | A * | 10/1999 |
| JP | 2001-159877 | | 6/2001 |
| JP | 2001-282206 | | 10/2001 |
| JP | 2001-296554 | | 10/2001 |
| JP | 2008-145837 | | 6/2008 |
| JP | 2008-216725 | | 9/2008 |

OTHER PUBLICATIONS

Japanese Office Action for Japanese Application No. 2009-163134 dated Nov. 13, 2012.

* cited by examiner

*Primary Examiner* — Chanh Nguyen
*Assistant Examiner* — Robert Stone
(74) *Attorney, Agent, or Firm* — Dentons US LLP

(57) ABSTRACT

A liquid crystal display device is provided, which may reduce flicker in all display gray levels. The liquid crystal display device includes a scan line drive circuit, a signal line drive circuit and a common connection line drive circuit. The common connection line drive circuit applies a voltage, the voltage having polarity opposite to polarity of the signal line, to a common connection line corresponding to a liquid crystal element as a selection object in a write period for writing into the liquid crystal element as a selection object, and applies one or multiple voltages, each voltage having a value different from a center value between an upper limit value and a lower limit value of voltages applied to the common connection lines in the write period, to the common connection lines in a holding period after writing into the liquid crystal element as a selection object is performed.

11 Claims, 32 Drawing Sheets

WRITING IN $V_L$

WRITING IN $V_H$

WRITING IN $V_L$

WRITING IN $V_H$

WRITING IN $V_L$

WRITING IN $V_H$

LIQUID CRYSTAL DISPLAY DEVICE WITH COMMON CONNECTION LINE VOLTAGE ADJUSTED IN A HOLDING PERIOD FOR AN IMPROVED PERFORMANCE

BACKGROUND OF THE INVENTION

1. Field of the Invention

The present invention relates to an active-matrix liquid crystal display device.

2. Description of Related Art

Recently, a liquid crystal display device is widely used, which drives display elements (liquid crystal elements) using liquid crystal for video display. In such a liquid crystal display device, arrangement of liquid crystal molecules is changed in a liquid crystal layer enclosed between substrates such as glass substrates, so that light from a light source is transmitted or modulated for display.

In the liquid crystal display device, active matrix drive is typically used. In such a drive method, frame reversal drive, in which polarity of voltage applied to liquid crystal is reversed every frame period, is performed to suppress degradation of liquid crystal. In addition, line reversal drive, in which polarity of voltage applied to liquid crystal is reversed every horizontal period (1H), is performed to suppress occurrence of flicker in each frame due to reversal of polarity of voltage applied to liquid crystal in the frame reversal drive. Furthermore, common reversal drive, in which polarity of voltage applied to a common electrode is reversed, is performed to reduce amplitude of a signal voltage applied to each pixel electrode.

The above previous drive methods are described in, for example, Japanese Patent Application, Publication Nos. 11-271787 and 2001-159877.

SUMMARY OF THE INVENTION

Recent advance in resolution and luminance of a display image reveals difficulties that have not been considered seriously. In particular, flicker and high power consumption are serious difficulties. As a cause of bad flicker, a fact is listed: display has been more affected by a current leaking from a pixel circuit through reduced pixel capacitance associated with high resolution. As another cause, a fact is listed: luminance of a light source has been increased to compensate reduction in luminance through reduction in aperture ratio associated with high resolution. Increase in power consumption is caused by the fact that luminance of a light source has been increased to compensate reduction in luminance through reduction in aperture ratio associated with high resolution as described above.

As a measure to suppress flicker, for example, improvement in manufacturing process or improvement in liquid crystal material is considered. However, in such a case, manufacturing cost or a trial production period has been increased, leading to a difficulty. Therefore, a center value ((upper limit value+lower limit value)/2) of voltages applied to the common electrode in the common reversal drive has been adjusted to a value at which flicker is minimized in the past.

However, the value at which flicker is minimized is different depending on display gray levels. This is because main causes of flicker are different between an intermediate gray level and a high gray level. Specifically, leakage current in a holding period is a main cause of flicker in the intermediate gray level, while a flexoelectric effect is a main cause of flicker in the high gray level. The flexoelectric effect refers to a phenomenon that polarization, which occurs at a molecular level in liquid crystal molecules due to asymmetry in shape of each liquid crystal molecule, comes up to the surface when the molecules are aligned.

Therefore, when the center value of voltages applied to the common electrode in the common reversal drive is adjusted to a value suitable for the intermediate gray level, flicker increases in the high gray level, and when the center value is adjusted to a value suitable for the high gray level, flicker increases in the intermediate gray level. In this way, flicker has not been easily suppressed in all display gray levels in the previous adjustment methods.

It is desirable to provide a liquid crystal display device that may reduce flicker in all display gray levels.

A liquid crystal display device according to an embodiment of the invention includes a pixel array section, a scan line drive circuit, a signal line drive circuit, and a common connection line drive circuit. The pixel array section has a plurality of scan lines arranged in columns, a plurality of signal lines arranged in rows, and a plurality of pixel circuits arranged in a matrix in correspondence to intersections between the scan lines and the signal lines, the pixel circuits being connected to scan lines and signal lines corresponding to the intersections, respectively. The pixel array section further has a plurality of liquid crystal elements arranged in a matrix in correspondence to the intersections, the liquid crystal elements being connected to the pixel circuits corresponding to the intersections, respectively, and a plurality of common connection lines connected to the plurality of liquid crystal elements for each row. The scan line drive circuit sequentially applies selection pulses to the plurality of scan lines to sequentially select the plurality of liquid crystal elements in scan lines as a unit. The signal line drive circuit applies a signal voltage corresponding to a video signal to each signal line such that polarity of the voltage is reversed every frame period for writing into a liquid crystal element as a selection object. The common connection line drive circuit applies a voltage, of which the polarity is opposite to polarity of the signal line, to a common connection line corresponding to a liquid crystal element as a selection object in a write period for writing into the liquid crystal element as a selection object. Furthermore, the common connection line drive circuit applies one or multiple voltages, each voltage having a value different from a center value between an upper limit value and a lower limit value of voltages applied to the common connection lines in the write period, to the common connection lines in a holding period after writing into the liquid crystal element as a selection object is performed.

In the liquid crystal display device according to the embodiment of the invention, one or multiple voltages, each voltage having a value different from a center value between an upper limit value and a lower limit value of voltages applied to common connection lines in a write period, is applied to the common connection lines in a holding period. Thus, a voltage value at which flicker is minimized in an intermediate gray level may be made similar to a voltage value at which flicker is minimized in a high gray level in a holding period compared with a case where a voltage equal to the center value is applied to the common connection lines.

According to the liquid crystal display device of the embodiment of the invention, a voltage value at which flicker is minimized in an intermediate gray level may be made similar to a voltage value at which flicker is minimized in a high gray level. Thus, flicker may be reduced in all display gray levels.

Other and further objects, features and advantages of the invention will appear more fully from the following description.

DETAILED DESCRIPTION OF THE PREFERRED EMBODIMENTS

Hereinafter, preferred embodiments of the invention will be described in detail with reference to drawings. Description is made in the following sequence.

1. First Embodiment (FIGS. 1 to 15)
   Example of applying one voltage to common connection lines COM in holding period $T_h$
2. Second Embodiment (FIGS. 16 to 35B)
   Example of applying multiple voltages to common connection lines COM in holding period $T_h$

First Embodiment

Schematic Configuration

Figure 1:
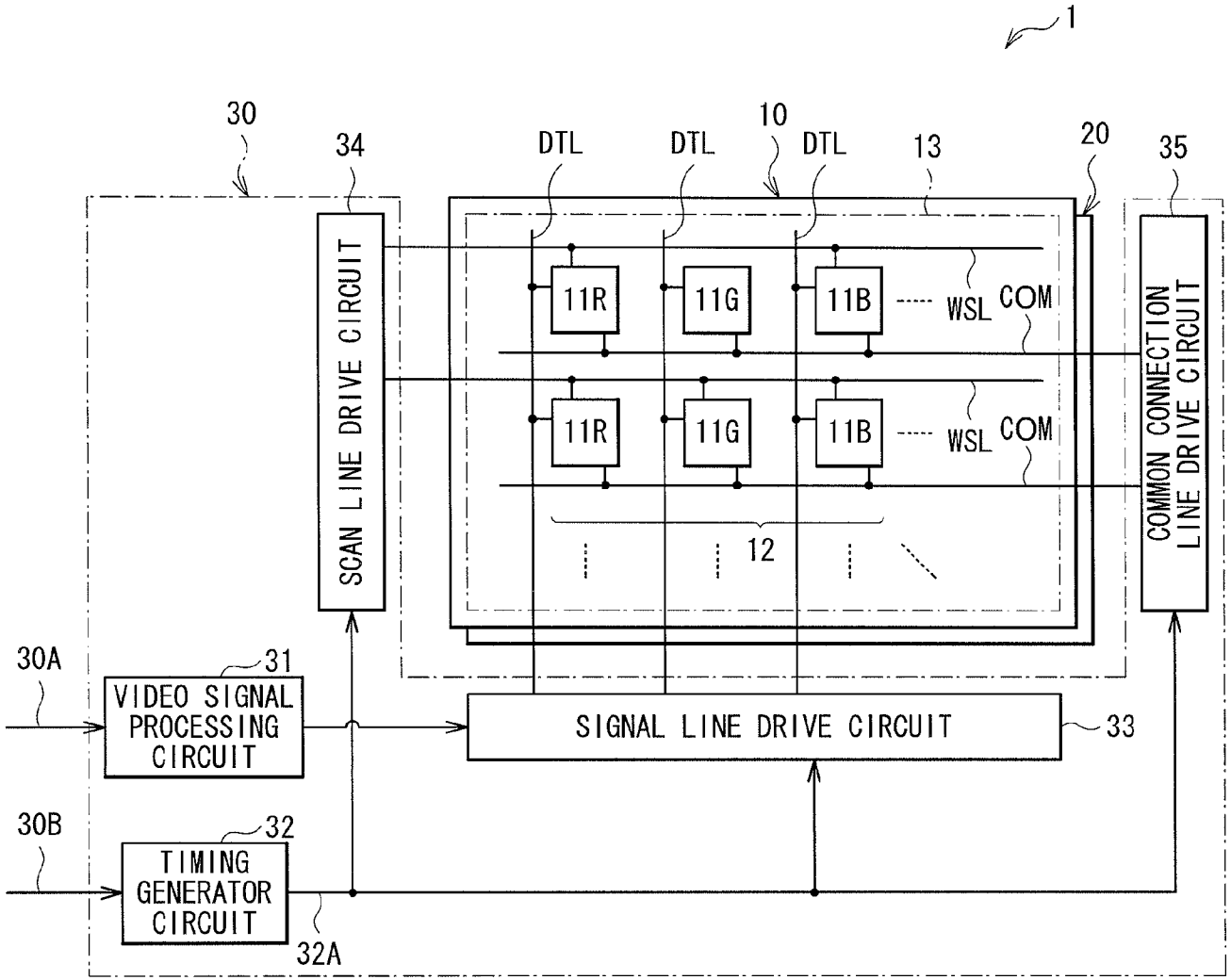
FIG. 1 is a schematic block diagram of a liquid crystal display device according to a first embodiment of the invention.

FIG. 1 shows a schematic configuration of a liquid crystal display device 1 according to a first embodiment of the invention. The liquid crystal display device 1 includes a liquid crystal display panel 10, a backlight 20 disposed in the back of the liquid crystal display panel 10, and a drive circuit 30 driving the liquid crystal display panel 10. The liquid crystal display panel 10 has, for example, a pixel array section 13 in which a plurality of sub pixels 11R, 11G and 11B are arranged in a matrix. In the embodiment, for example, sub pixels 11R, 11G and 11B adjacent to one another configure one pixel 12. Hereinafter, sub pixel 11 is appropriately used as a general term of the sub pixels 11R, 11G and 11B. The drive circuit 30 has, for example, a video signal processing circuit 31, a timing generator circuit 32, a signal line drive circuit 33, a scan line drive circuit 34, and a common connection line drive circuit 35.

Pixel Array Section 13

Figure 2:
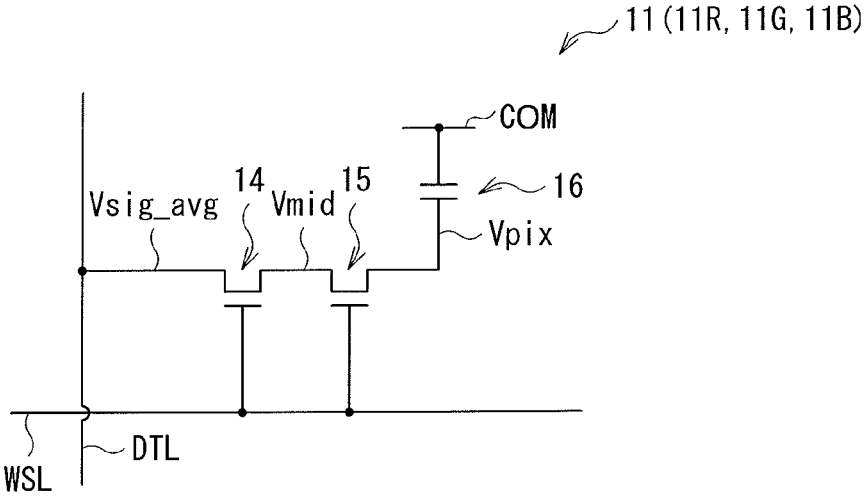
FIG. 2 is a configuration diagram of a sub pixel in FIG. 1.

FIG. 2 shows an example of a circuit configuration within the pixel array section 13. The pixel array section 13 has, for example, a plurality of scan lines WSL arranged in rows and a plurality of signal lines DTL arranged in columns as shown in FIGS. 1 and 2. A plurality of sub pixels 11R, 11G and 11B are arranged in a matrix in correspondence to intersections between the scan lines WSL and the signal lines DTL. Furthermore, in the pixel array section 13, a plurality of common connection lines COM are arranged one by one in correspondence to the sub pixels 11R, 11G and 11B in each column.

Each sub pixel 11 has, for example, two transistors 14 and 15 and a liquid crystal element 16 as shown in FIG. 2. The two transistors 14 and 15 correspond to a specific example of "pixel circuit" in an embodiment of the invention. The liquid crystal element 16 has, for example, a common electrode, an insulating film, a pixel electrode, an alignment film, a liquid crystal layer, an alignment film and a transparent substrate on a drive substrate in order from a drive substrate side. The drive substrate includes, for example, the transistors 14 and 15 formed on a glass substrate. The common electrode is a strip-shaped electrode provided for each horizontal line (each row), and commonly used for liquid crystal elements 16 included in a plurality of sub pixels 11 in one horizontal line. For example, the common electrode configures part of the common connection line COM and thus electrically connected to the common connection line COM. The insulating film, which isolates the common electrode from the pixel electrode, gives a vertical gap between the common electrode and the pixel electrode. The liquid crystal layer includes, for example, liquid crystal of a VA (Vertical Alignment) mode or an IPS (In-Plane Switching) mode, and has a function of transmitting or blocking light emitted from the backlight 20 depending on applied voltage. The pixel electrode acts as an electrode for each sub pixel 11, and is disposed, for example, in a region being not opposed to the common electrode. Thus, when a voltage is applied between the pixel electrode and the common electrode, a transverse electric field is formed within the liquid crystal layer. Each of the transistors 14 and 15 is, for example, field-effect TFT (Thin Film Transistor), and includes a gate controlling a channel, and a source and a drain provided on both sides of the channel. Each of the transistors 14 and 15 may be a p-type transistor or an n-type transistor.

One end of the liquid crystal element 16 is connected to the source or drain of the transistor 15, and the other end thereof is connected to the common connection line COM. The gates of the transistors 14 and 15 are connected to the scan line WSL, and one of the source and drain of the transistor 15, which is unconnected to the liquid crystal element 16, is connected to the source or drain of the transistor 14. One of the source and drain of the transistor 14, which is unconnected to the transistor 15, is connected to the signal line DTL. In a plurality of sub pixels 11 in one horizontal line, for example, the gates of the transistors 14 and 15 are connected to the common scan line WSL. That is, a plurality of sub pixels 11 connected to one scan line WSL are arranged in a line along the scan line WSL.

In one horizontal line, while not shown, for example, gates of transistors 14 and 15 of one sub pixel 11 may be connected to one scan line WSL of two scan lines WSL provided on both sides of each sub pixel 11, and gates of transistors 14 and 15 of the other sub pixel 11 may be connected to the other scan line WSL of the two scan lines WSL. In this case, a plurality of sub pixels 11 connected to one scan line WSL may be alternately (zigzag) arranged with respect to the scan line WSL. In such a case, liquid crystal elements 16 selected by one scan line WSL among a plurality of liquid crystal elements 16 are alternately arranged with respect to the one scan line WSL.

Backlight 20

The backlight 20 irradiates the liquid crystal display panel 10 from the back, and includes, for example, a light guide plate, a light source disposed on a side face of the light guide plate, and an optical element disposed on a top (light emitting surface) of the light guide plate. The light guide plate guides light from the light source to the top of the light guide plate, and has, for example, a predetermined patterned-shape on at least one of the top and a bottom, and thus has a function of scattering light entering from a side face to uniform the light. The light source is a linear light source, and includes, for example, a hot cathode fluorescent lamp (HCFL), a cold cathode fluorescent lamp (CCFL), or a plurality of light emitting diodes (LED) arranged in a line. The optical element is formed by stacking a diffuser plate, a diffuser sheet, a lens film, a polarization separation sheet and the like. The backlight 20 may be a direct backlight having a diffuser plate and other optical elements directly above a light source.

Drive Circuit 30

Next, each of the circuits in the drive circuit 30 provided in the periphery of the pixel array section 13 will be described with reference to FIG. 1.

The video signal processing circuit 31 corrects a digital video signal 30A inputted from the outside, and converts a corrected video signal into an analog signal and outputs the analog signal to the signal line drive circuit 33. The timing generator circuit 32 controls the signal line drive circuit 33, the scan line drive circuit 34, and the common connection line drive circuit 35 so that the circuits operate in conjunction with one another. For example, the timing generator circuit 32 outputs a control signal 32A to each of the circuits in response to (in synchronization with) a synchronizing signal 30B inputted from the outside.

Figure 3:
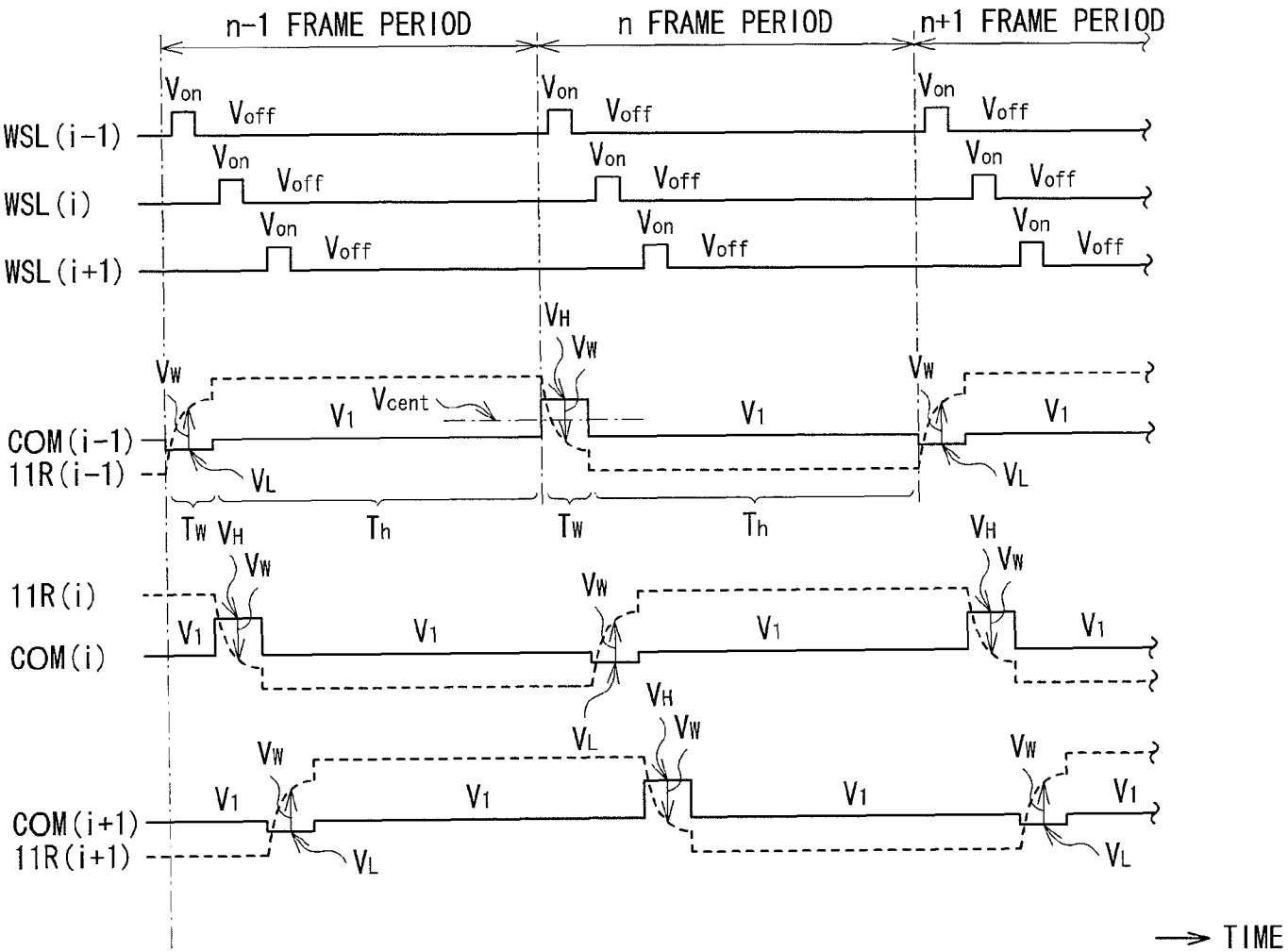
FIG. 3 is a waveform diagram showing an example of operation of the liquid crystal display device of FIG. 1.
Figure 5:
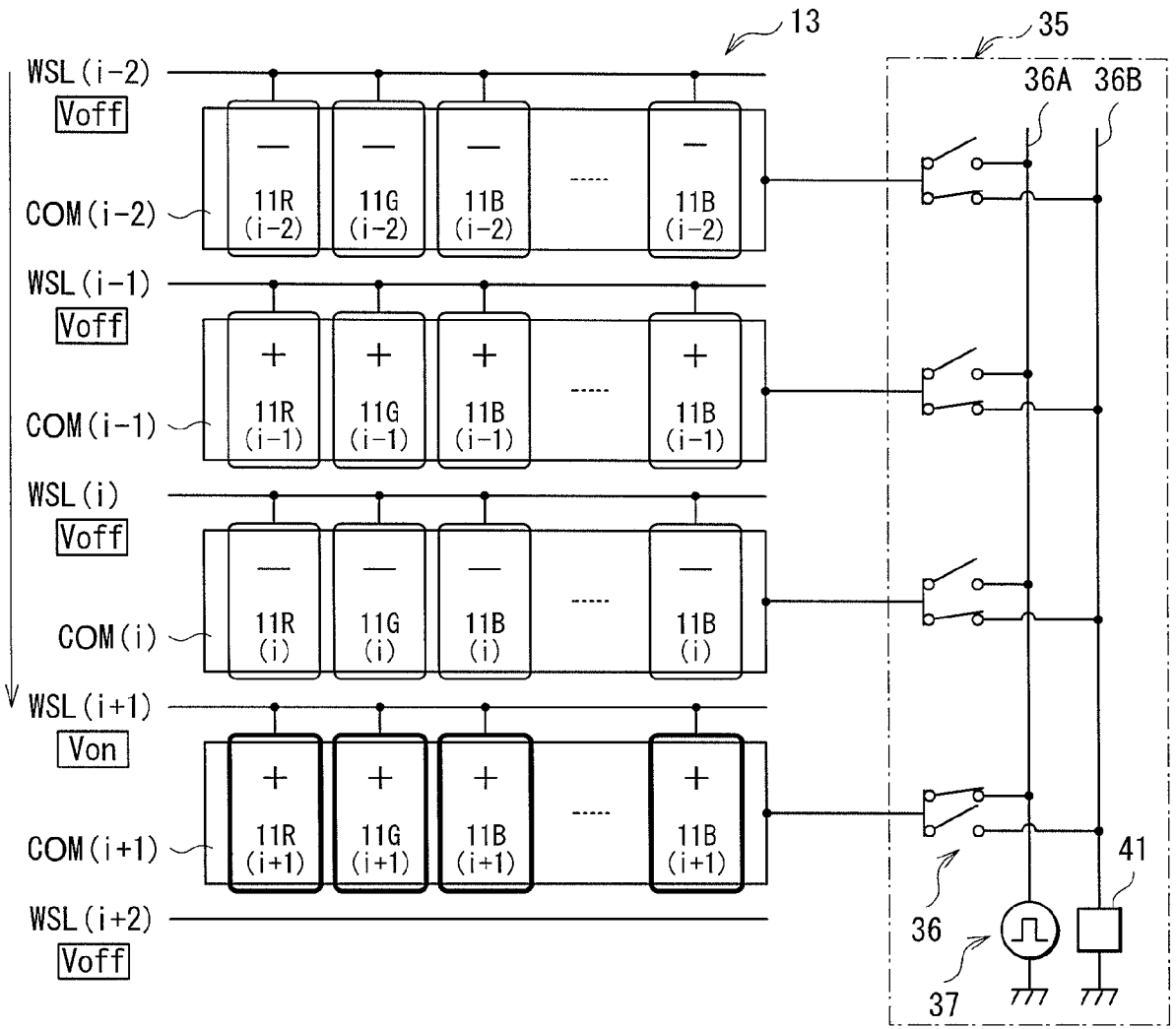
FIG. 5 is a schematic diagram showing operation following the operation of FIG. 4.
Figure 6:
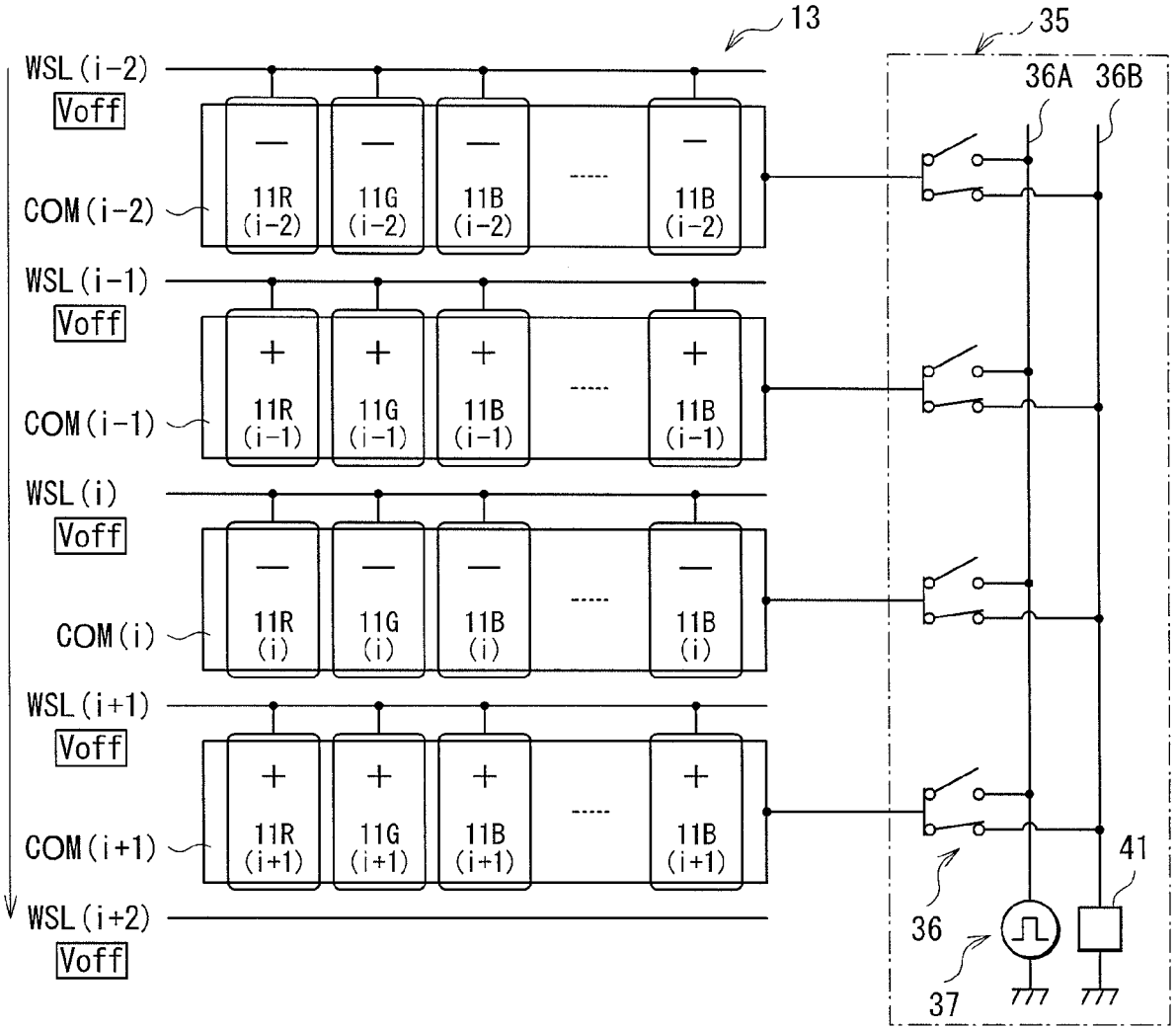
FIG. 6 is a schematic diagram showing operation following the operation of FIG. 5.
Figure 7:
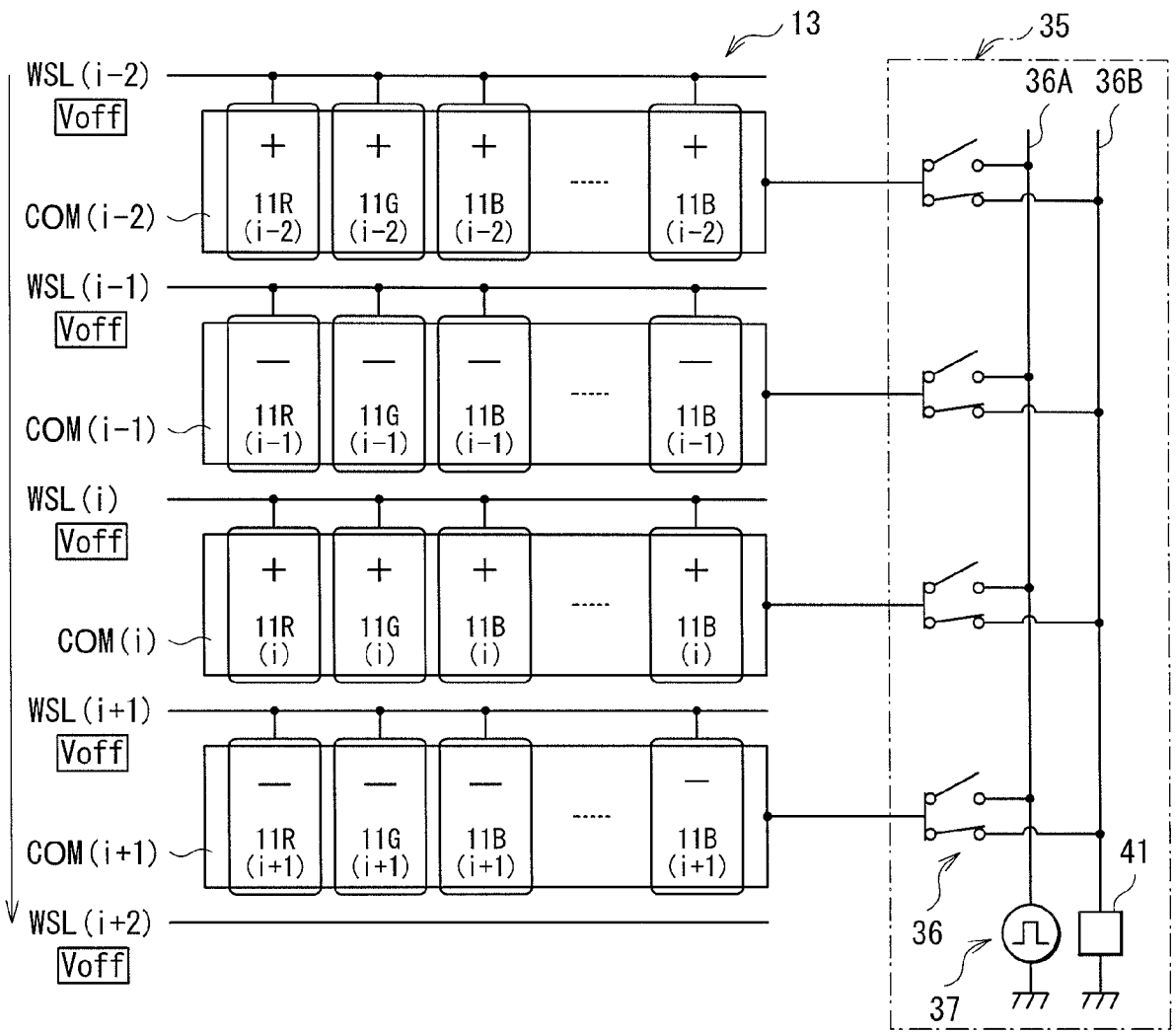
FIG. 7 is a schematic diagram showing another example of operation of the liquid crystal display device of FIG. 1.

The signal line drive circuit 33 applies the analog video signal (signal voltage corresponding to the video signal 30A) inputted from the video signal processing circuit 31 to each signal line DTL to write the signal to a sub pixel 11 as a selection object. For example, the signal line drive circuit 33 may output a signal voltage $V_{sig}$ corresponding to the video signal 30A. For example, the signal line drive circuit 33 may perform frame reversal drive, in which a signal voltage $V_{sig}$, of which the polarity is reversed every frame period with respect to a reference voltage $V_{ref}$, is applied to each signal line DTL so that the signal is written to a sub pixel 11 as a selection object, as shown in FIGS. 3, 6 and 7 described later. The frame reversal drive is to suppress degradation of the liquid crystal element 16, and used as necessary. Furthermore, for example, the signal line drive circuit 33 may perform 1H reversal drive, in which a signal voltage $V_{sig}$, of which the polarity is reversed every 1H period with respect to the reference voltage $V_{ref}$, is applied to each signal line DTL so that a voltage corresponding to the signal voltage $V_{sig}$ is written to a sub pixel 11 as a selection object, as shown in FIGS. 3 to 6 described later. The 1H reversal drive is to suppress occurrence of flicker in each frame due to reversal of polarity of a voltage applied to the liquid crystal element 16, and used as necessary. The reference voltage $V_{ref}$ is, for example, zero volt.

The scan line drive circuit 34 applies selection pulses to a plurality of scan lines in response to (in synchronization with) input of a control signal 32A to select a plurality of sub pixels 11 in a desired unit. As a unit of selecting the sub pixels 11, a various number of lines may be selected as necessary, for example, one line or adjacent two lines. In addition, the lines may be selected sequentially or randomly. For example, the scan line drive circuit 34 may output a voltage $V_{on}$ applied when the transistor 15 is turned on, and a voltage $V_{off}$ applied when the transistor 15 is turned off. The voltage $V_{on}$ has a value (fixed value) equal to or larger than a value of on voltage of the transistor 15. The voltage $V_{off}$ has a value (fixed value) smaller than a value of the on voltage of the transistor 15.

Next, the common connection line drive circuit 35 will be described. FIG. 3 is a timing chart showing an example of operation of the liquid crystal display device 1. FIG. 3 shows a waveform in each of n−1, n, and n+1 frame periods. In FIG. 3, the scan lines WSL, the common connection lines COM, and the sub pixels 11R are suffixed with (i) ($1 \leqq i$) for discrimination between individuals. Moreover, signal waveforms in other sub pixels 11G and 11B are omitted in FIG. 3.

Figure 4:
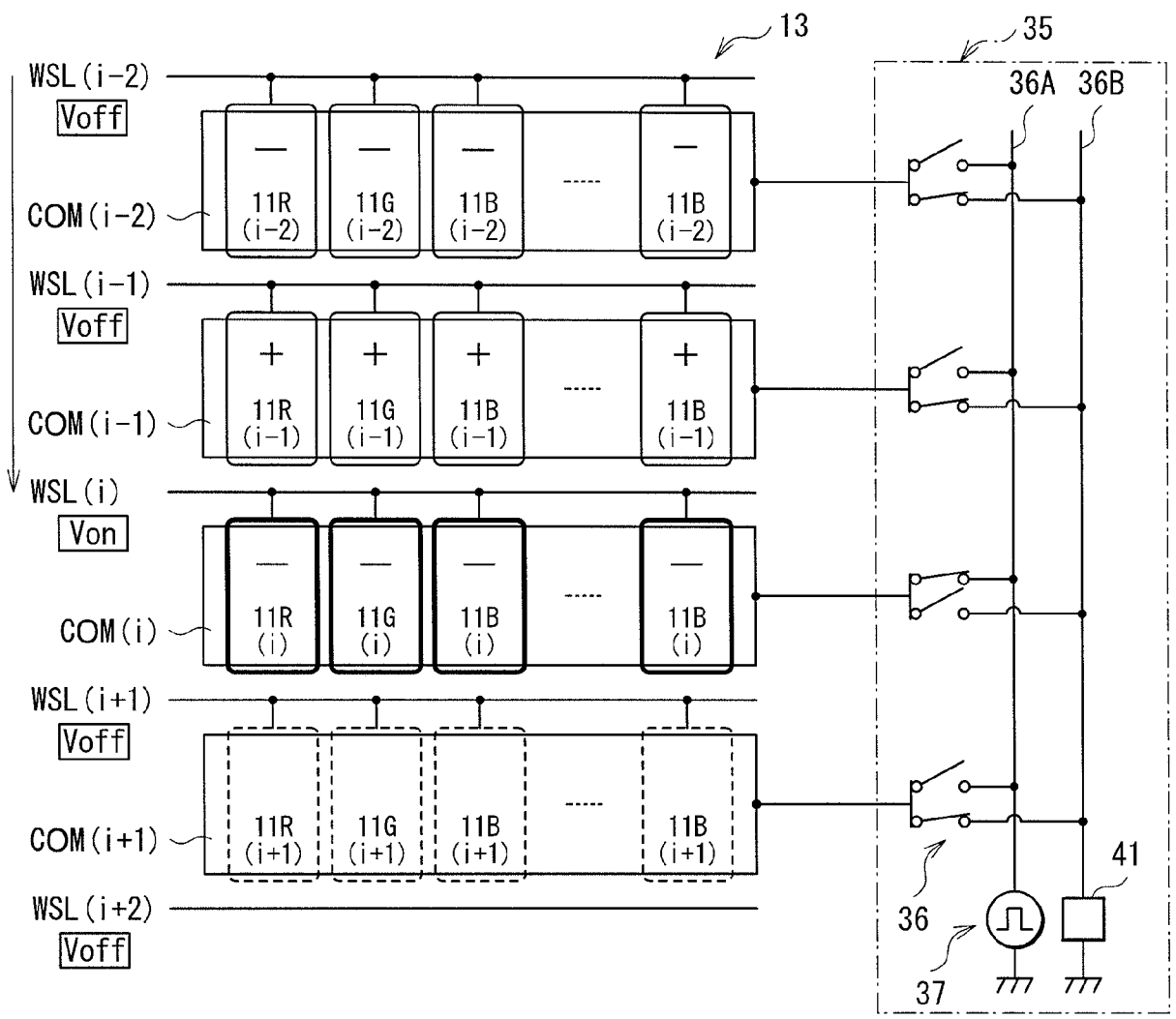
FIG. 4 is a schematic diagram showing an example of operation of the liquid crystal display device of FIG. 1.

FIG. 4 schematically shows polarity of a sub pixel 11 at a timing when $V_{on}$ is applied to a scan line WSL (i) in the n−1 frame period in FIG. 3. FIG. 5 schematically shows polarity of a sub pixel 11 at a timing when $V_{on}$ is applied to a scan line WSL (i+1) in the n−1 frame period in FIG. 3. FIG. 6 schematically shows polarity of a sub pixel 11 immediately after voltage of a common connection line COM corresponding to a sub pixel 11R (i−1) is changed from $V_1$ to $V_2$ (described later) in the n−1 frame period in FIG. 3. FIG. 7 schematically shows polarity of a sub pixel 11 immediately after voltage of the common connection line COM corresponding to the sub pixel 11R (i−1) is changed from $V_1$ to $V_2$ (described later) in the n frame period in FIG. 3. FIGS. 4 to 7 show polarity of a sub pixel 11 in the case that the signal line drive circuit 33 performs 1H reversal drive and frame reversal drive. In FIGS. 4 and 5, each sub pixel 11 enclosed by a thick frame means that the sub pixel is selected by a scan line WSL (i) or a scan line WSL (i+1). In FIGS. 4 to 7, each sub pixel 11 enclosed by a thin frame means that the sub pixel has been selected by a scan line WSL and is in a holding period $T_h$. In FIGS. 4 and 5, each sub pixel 11 enclosed by a dotted frame means that the sub pixel has not been selected yet by a scan line.

The above "polarity of a sub pixel 11" means that whether voltage of a sub pixel 11 (each broken line in FIG. 3) is positive or negative with respect to voltage ($V_L$ or $V_H$) ($V_L<V_H$) of the common connection line COM in a write period $T_w$. For example, as shown in FIG. 3, when $V_{on}$ is applied to the scan line WSL (i), for example, voltage of a sub pixel 11R (i) is negative with respect to the voltage $V_H$. Therefore, in this case, the sub pixel 11R (i) is regarded to have negative polarity. In contrast, for example, when $V_{on}$ is applied to the scan line WSL (i+1), voltage applied to the sub pixel 11R (i+1) is positive with respect to the voltage $V_L$. Therefore, in this case, the sub pixel 11R (i+1) is regarded to have positive polarity.

While the signal line drive circuit 33 performs 1H reversal drive, the common connection line drive circuit 35 performs common reversal drive, in which polarity of voltage supplied to the common electrodes (common connection lines COM) is reversed by a predetermined number of lines. Specifically, the common connection line drive circuit 35 applies a voltage, of which the polarity with respect to the reference voltage $V_{ref}$ is opposite to polarity of the signal line DTL with respect to the reference voltage $V_{ref}$, to a common connection line COM corresponding to a sub pixel 11 as a selection object. For example, as shown in FIGS. 3 to 6, when polarity of the signal line DTL is positive with respect to the reference voltage $V_{ref}$, the common connection line drive circuit 35 applies the voltage $V_L$, of which the polarity is negative with respect to the reference voltage $V_{ref}$, to the common connection lines COM. Moreover, for example, as shown in FIGS. 3 to 6, when polarity of the signal line DTL is negative with respect to the reference voltage $V_{ref}$, the common connection line drive circuit 35 applies the voltage $V_H$, of which the polarity is positive with respect to the reference voltage $V_{ref}$, to the common connection lines COM.

Moreover, the common connection line drive circuit 35 applies multiple voltages different from one another to the common electrode (common connection lines COM) in the holding period $T_h$. For example, as shown in FIGS. 3 to 6, the common connection line drive circuit 35 applies a voltage $V_1$, which is different from a center value (voltage $V_{cent}$) between the upper limit value ($V_H$) and the lower limit value ($V_L$) of voltages ($V_L$ and $V_H$) applied to the common connection lines COM in the write period $T_w$, to the common connection lines COM in the holding period $T_h$. The voltage $V_1$ has a value smaller than a value of the voltage $V_{cent}$, and larger than the lower limit value ($V_L$).

The common connection line drive circuit 35 electrically isolates a common connection line COM disposed in correspondence to a sub pixel 11 as a selection object from a plurality of common connection lines COM disposed in correspondence to sub pixels 11 as a non-selection object in the holding period $T_h$. For example, as shown in FIGS. 3 and 5, the common connection line drive circuit 35 electrically isolates a common connection line COM(i+1) applied with the voltage $V_L$ from common connection lines COM(i−2), COM (i−1) and COM(i) applied with the voltage $V_1$ in the holding period $T_h$.

Furthermore, in the embodiment, while the signal line drive circuit 33 performs frame reversal drive, the common connection line drive circuit 35 performs common reversal drive, in which polarity of a voltage supplied to the common electrode (common connection lines COM) is reversed every frame period, as shown in FIGS. 3, 6 and 7. For example, as shown in FIGS. 6 and 7, the common connection line drive circuit 35 reverses polarity of a voltage applied to each sub pixel 11 such that polarity of a sub pixel 11 after a lapse of an n−1 frame period is opposite to polarity of a sub pixel 11 after a lapse of an n frame period.

Next, an internal configuration of the common connection line drive circuit 35 will be described. The common connection line drive circuit 35 has, for example, switching elements 36, each of which is electrically connected to each common connection line COM, as shown in FIG. 4. Each switching element 36 is provided for each common connection line COM, and has, for example, two output terminals. A first output terminal of the switching element 36 is connected to a wiring 36A, and connected to an output terminal of a pulse generator 37 via the wiring 36A. A second output terminal of the switching element 36 is connected to a wiring 36B. For example, the wiring 36B is connected to an output terminal of a logic circuit 41 as shown in FIG. 4. The pulse generator 37 periodically outputs the predetermined voltages $V_H$ and $V_L$ to the wiring 36A. The logic circuit 41 outputs the predetermined voltage $V_1$ to the wiring 36B.

The common connection line drive circuit 35 connects a common connection line COM, which is disposed in correspondence to a horizontal line including sub pixels 11 (as a selection object) being on through application of $V_{on}$ to a scan line WSL, to an output terminal of the pulse generator 37. For example, as shown in FIG. 4, the common connection line drive circuit 35 connects a common connection line COM(i), which is disposed in correspondence to a row including sub pixels 11R(i), 11G(i) and 11B(i) as a selection object, to output of the pulse generator 37 via the switching element 36 and the wiring 36A so that voltage of the line COM(i) is $V_H$. In addition, for example, as shown in FIG. 5, the common connection line drive circuit 35 connects a common connection line COM(i+1), which is disposed in correspondence to a row including sub pixels 11R(i+1), 11G(i+1) and 11B(i+1) as a selection object, to output of the pulse generator 37 via the switching element 36 and the wiring 36A so that voltage of the line COM(i+1) is $V_L$.

The common connection line drive circuit 35 connects a common connection line COM, which is disposed in correspondence to a plurality of horizontal lines including sub pixels 11 (as a non-selection object) being off through application of the voltage $V_{off}$ to scan lines WSL, to the wiring 36B. For example, as shown in FIGS. 3 and 5, the common connection line drive circuit 35 connects common connection lines COM(i−2), COM(i−1) and COM(i), which are disposed in correspondence to three rows including sub pixels 11R(i−2), 11R(i−1) and 11R(i) as a non-selection object, to the wiring 36B via the switching elements 36 so that voltage of each of the lines is $V_1$.

While not shown, the common connection line drive circuit 35 may have a constant voltage supply 38 in place of the logic circuit 41.

Next, operation of the liquid crystal display device 1 according to the embodiment will be described.

Write Period $T_w$

In a write period $T_w$ as the first half of each frame period, the scan line drive circuit 34 applies the voltage $V_{on}$ to a plurality of scan lines WSL in a desired number of lines as a unit so that transistors 14 and 15 are turned on. Furthermore, the signal line drive circuit 33 applies the signal voltage $V_{sig}$ to each signal line DTL, and the common connection line drive circuit 35 applies the signal voltage $V_L$ or $V_H$ to a common connection line COM corresponding to a sub pixel 11 as a selection object.

At that time, the signal line drive circuit 33 applies a signal voltage $V_{sig}$, of which the polarity is reversed every 1H period and, reversed every frame period with respect to the reference voltage $V_{ref}$, to each signal line DTL (1H reversal drive and frame reversal drive). Furthermore, the common connection line drive circuit 35 applies a voltage, of which the polarity with respect to the reference voltage $V_{ref}$ is opposite to polarity of the signal line DTL with respect to the reference voltage $V_{ref}$, to a common connection line COM corresponding to a sub pixel 11 as a selection object in the write period $T_w$ of each frame period (common reversal drive). Thus, a voltage $V_w$ corresponding to the signal voltage $V_{sig}$ is written into the sub pixel 11 as a selection object in the write period $T_w$ (see FIG. 3). In the embodiment, the voltage $V_w$ is written with 1H reversal drive, frame reversal drive and common reversal drive. This may reduce amplitude of a signal voltage applied to the sub pixel 11, and thus power consumption may be controlled to be low.

Holding Period $T_h$

In a holding period $T_h$ as the second half of each frame period, the scan line drive circuit 34 applies the voltage $V_{off}$ to scan lines WSL corresponding to sub pixels 11 as a non-selection object so that transistors 14 and 15 are turned off. Thus, the voltage $V_w$ written during the write period $T_w$ is kept in each of the sub pixels 11 as a non-selection object. As a result, each sub pixel 11 is lighted with a luminance corresponding to the voltage $V_w$.

Figure 8A:
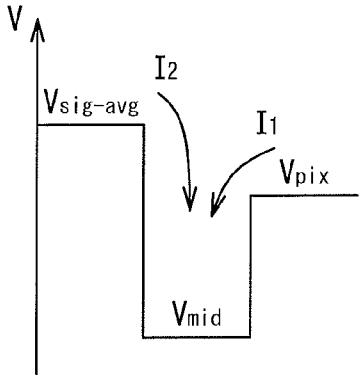
FIGS. 8A and 8B are conceptual diagrams for illustrating leakage current within the sub pixel in FIG. 1.
Figure 8B:
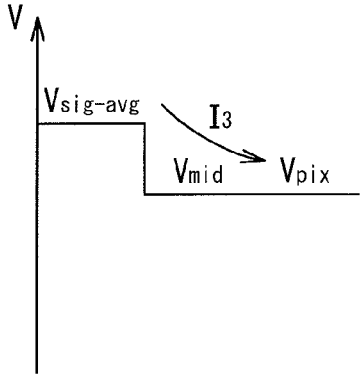

The voltage $V_w$ is principally not easily kept during the holding period $T_h$. For example, in the $V_H$ frame period, as shown in FIGS. 2 and 8A, when the transistors 14 and 15 are turned off, a voltage $V_{mid}$ of an intermediate node as a connection point between the transistors 14 and 15 is brought into coupling to be pulled in a negative direction. Thus, since the voltage $V_{mid}$ becomes similar to the off voltage of the transistors 14 and 15, a leakage current $I_1$ flows from the liquid crystal element 16 to the transistors 14 and 15 side, and a leakage current $I_2$ flows from the signal line DTL to the transistors 14 and 15 side. Immediately after writing in the $V_H$ frame period, as shown in FIG. 8B, since a voltage $V_{pix}$ of the liquid crystal element 16 is lower than an average value (voltage $V_{sig\text{-}ave}$) of voltages of the signal lines DTL reversed in polarity every 1H, a leakage current $I_3$ flows from the signal line DTL to the transistors 14 and 15 side. The voltage $V_{sig\text{-}ave}$ represents the average value of voltages of the signal lines DTL reversed in polarity every 1H.

Figure 9A:
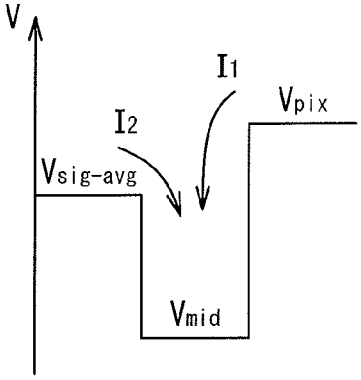
FIGS. 9A and 9B are other conceptual diagrams for illustrating leakage current within the sub pixel in FIG. 1.
Figure 9B:
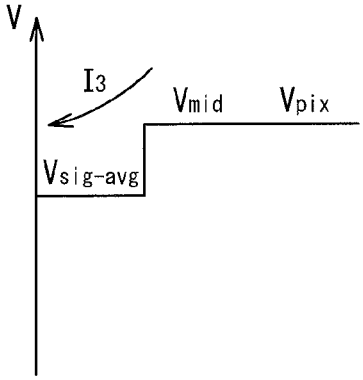

For example, in the $V_L$ frame period, as shown in FIGS. 2 and 9A, when the transistors 14 and 15 are turned off, the voltage $V_{mid}$ of the intermediate node as a connection point between the transistors 14 and 15 is brought into coupling to be pulled in a negative direction. Thus, since the voltage $V_{mid}$ becomes similar to the off voltage of the transistors 14 and 15, a leakage current $I_1$ flows from the liquid crystal element 16 to the transistors 14 and 15 side, and a leakage current $I_2$ flows from the signal line DTL to the transistors 14 and 15 side. Immediately after writing in the $V_L$ frame period, as shown in FIG. 9B, since the voltage $V_{pix}$ of the liquid crystal element 16 is higher than an average value (voltage $V_{sig\text{-}ave}$) of voltages of the signal lines DTL reversed in polarity every 1H, a leakage current $I_3$ flows from the transistors 14 and 15 side to the signal line DTL. The voltage $V_{sig\text{-}ave}$ is the average value of voltages of the signal lines DTL reversed in polarity every 1H.

Figure 10:
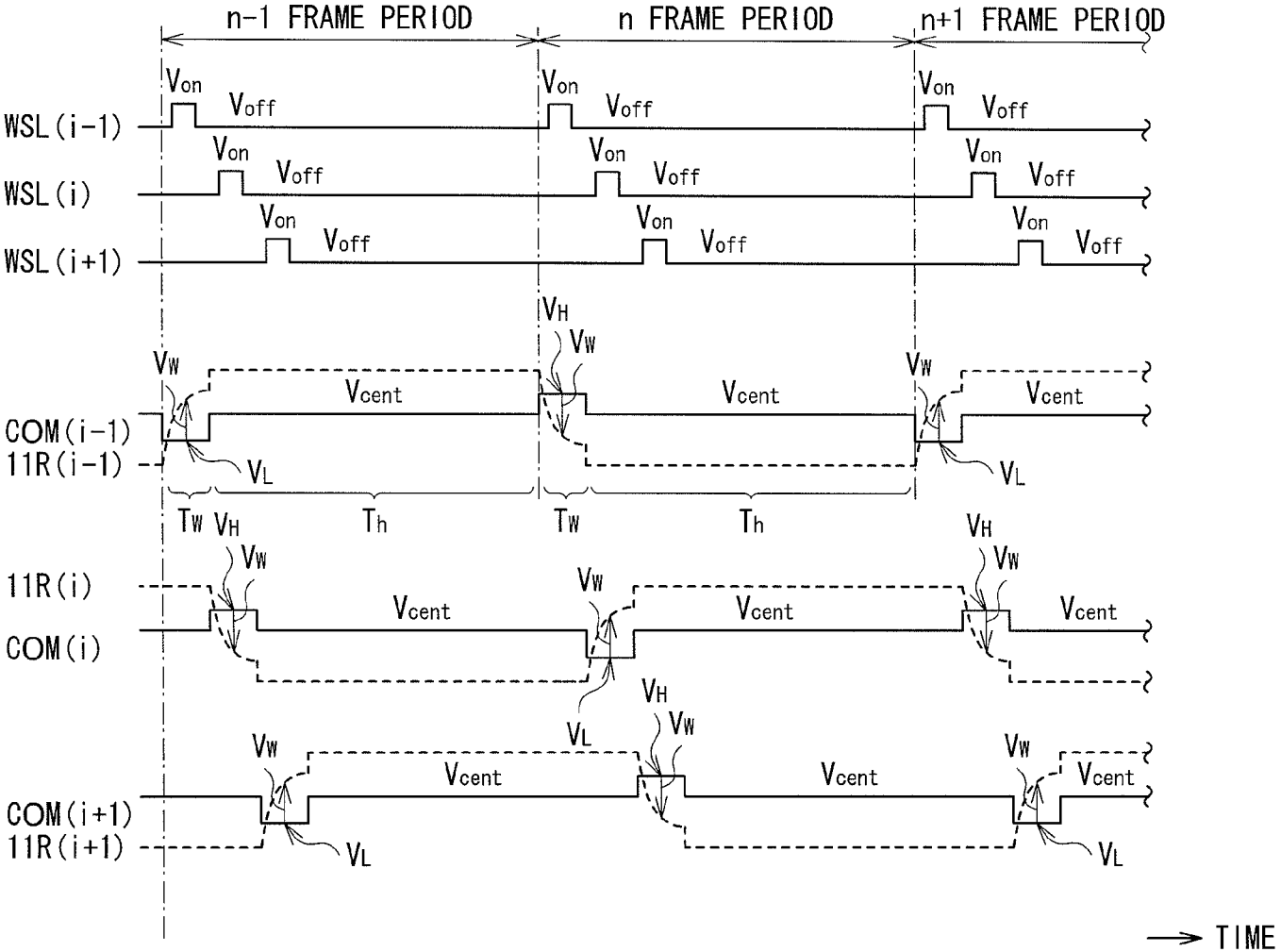
FIG. 10 RELATED ART
FIG. 10 is a waveform diagram showing an example of operation of a liquid crystal display device in related art.
Figure 11B:
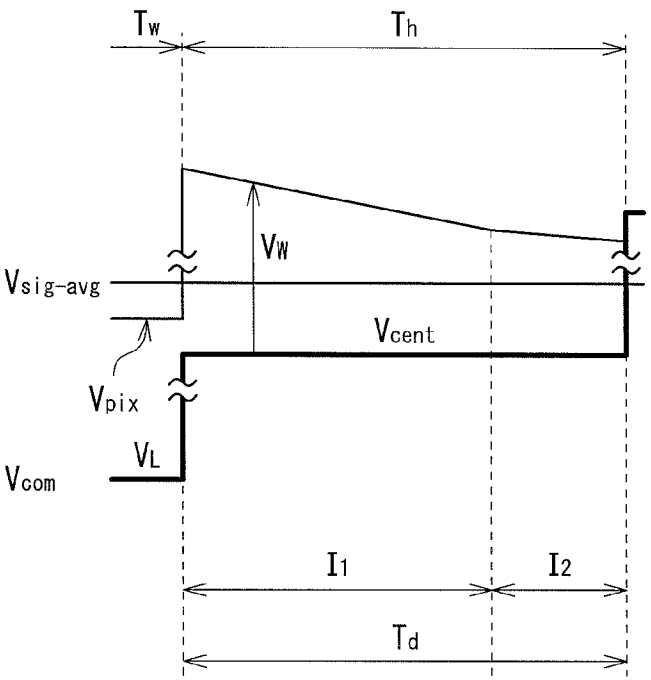
FIG. 11B RELATED ART
FIGS. 11A and 11B are waveform diagrams for illustrating voltage applied to a liquid crystal element in the liquid crystal display device of FIG. 10.
Figure 11A:
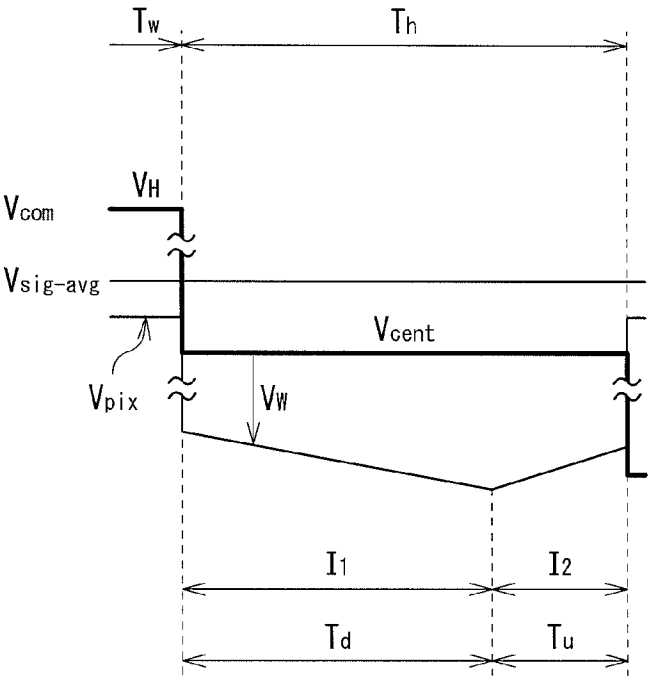
FIG. 11A RELATED ART

Therefore, for example, when the common connection line drive circuit 35 continuously applies a voltage $V_{cent}$ to common connection lines COM corresponding to sub pixels 11 as a non-selection object in the holding period $T_h$ as shown in FIG. 10, the voltage $V_{pix}$ is as shown in FIGS. 11A and 11B. Specifically, in the $V_H$ frame period, the voltage changes in a negative direction in the first half of the holding period $T_h$, and then changes in a positive direction as shown in FIG. 11A. In this way, in the $V_H$ frame period, the holding period $T_h$ has a period $T_d$, in which the voltage $V_{pix}$ changes in the negative direction, in the first half of the period, and has a period $T_u$, in which the voltage $V_{pix}$ changes in the positive direction, in the second half thereof. In contrast, in the $V_L$ frame period, the voltage $V_{pix}$ changes in a negative direction in each of the first half and the second half of the holding period $T_h$ as shown in FIG. 11B. In this way, the holding period $T_h$ has only a period $T_d$, in which the voltage $V_{pix}$ changes in the negative direction, in the $V_L$ frame period.

FIGS. 11A and 11B show waveforms in the case that the transistors 14 and 15 are an n-type transistor. In the case that the transistors 14 and 15 are a p-type transistor, the holding period $T_h$ has only the period $T_u$, in which the voltage $V_{pix}$ changes in a positive direction, in the $V_H$ frame period, and has the period $T_d$, in which the voltage $V_{pix}$ changes in the negative direction, and the period $T_u$, in which the voltage $V_{pix}$ changes in the positive direction, in the $V_L$ frame period.

Figure 12B:
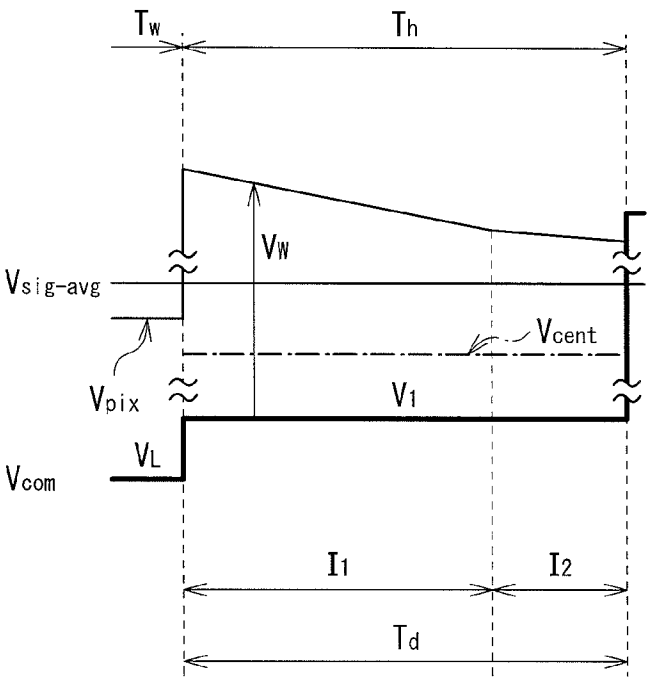
FIGS. 12A and 12B are waveform diagrams for illustrating voltage applied to a liquid crystal element in the liquid crystal display device of FIG. 1.
Figure 12A:
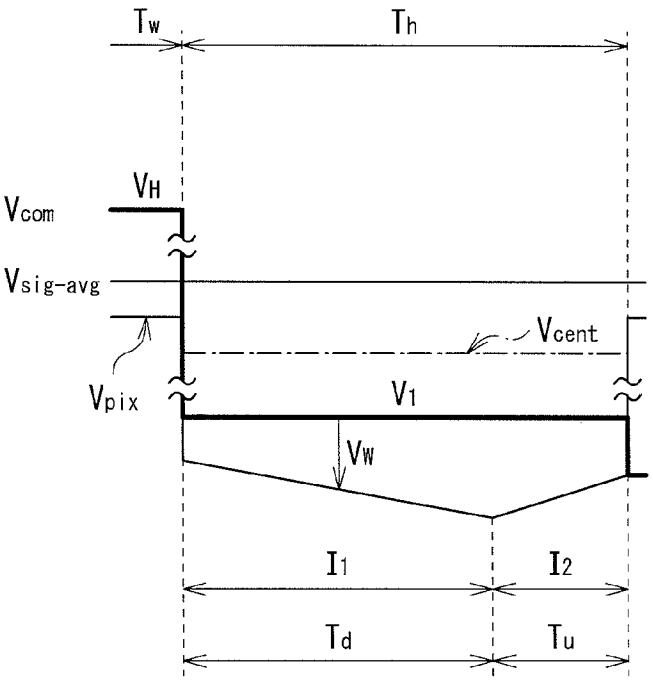

In the embodiment, for example, the common connection line drive circuit 35 continuously applies a voltage $V_1$ ($<V_{cent}$) to common connection lines COM corresponding to sub pixels 11 as a non-selection object in the holding period $T_h$ as shown in FIG. 3. Thus, the voltage $V_{pix}$ is as shown in FIGS. 12A and 12B. Specifically, in the $V_H$ frame period, as shown in FIG. 12A, the voltage $V_{pix}$ changes in a negative direction in the first half of the holding period $T_h$, and then changes in a positive direction as in FIG. 11A. In this way, in the $V_H$ frame period, the holding period $T_h$ has a period $T_d$, in which the voltage $V_{pix}$ changes in the negative direction, in the first half of the period, and has a period $T_u$, in which the voltage $V_{pix}$ changes in the positive direction, in the second half thereof. Magnitude of a voltage $V_w$ applied to the liquid crystal element 16 in the holding period $T_h$ is equal to magnitude of a voltage $V_w$ applied to the liquid crystal element 16 in the write period $T_w$. In contrast, in the $V_L$ frame period, as shown in FIG. 12B, the voltage $V_{pix}$ changes in a negative direction in each of the first half and the second half of the holding period $T_h$ as in FIG. 11B. In this way, the holding period $T_h$ has only a period $T_d$ in which the voltage $V_{pix}$ changes in the negative direction in the $V_L$ frame period. Even in this case, magnitude of a voltage $V_w$ applied to the liquid crystal element 16 in the holding period $T_h$ is equal to magnitude of a voltage $V_w$ applied to the liquid crystal element 16 in the write period $T_w$. That is, in the embodiment, voltage of the common connection line COM is adjusted in the holding period $T_h$, thereby magnitude of a voltage $V_w$ applied to the liquid crystal element 16 is controlled without changing magnitude of the voltage $V_w$.

Figure 13:
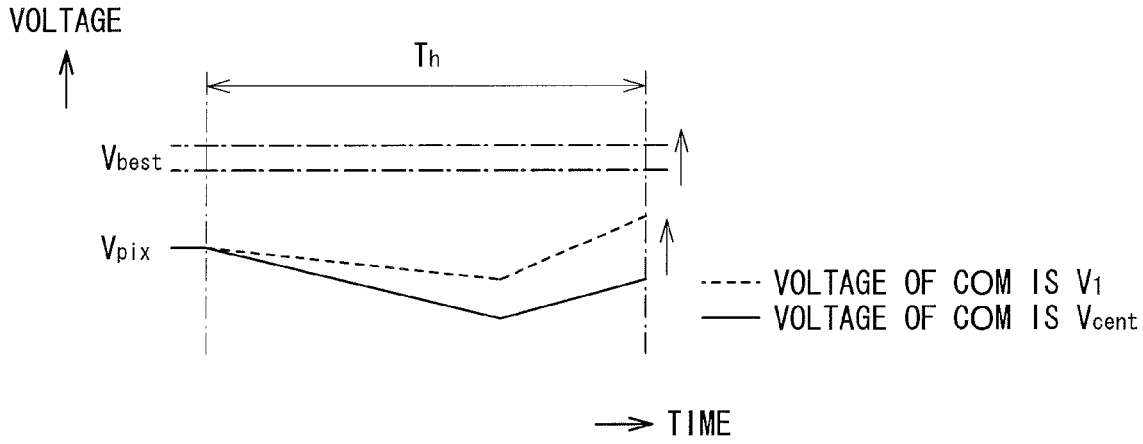
FIG. 13 is a waveform diagram for illustrating voltage applied to a liquid crystal element in the case that the leakage current in FIG. 8A occurs.

Next, description will be made on an advantage obtained by adjusting the voltage of the common connection line COM in the holding period $T_h$. In the embodiment, magnitude of a voltage $T_w$, applied to the liquid crystal element 16 is controlled by adjusting the voltage of the common connection line COM in the holding period $T_h$ as described before. For example, in the $V_H$ frame period, the voltage of the common connection line COM is adjusted to the voltage $V_1$ ($<V_{cent}$) in the holding period $T_h$. Thus, the voltage $V_{pix}$ of the liquid crystal element 16 is reduced compared with a case where the voltage of the common connection line COM in the holding period $T_h$ is adjusted to the voltage $V_{cent}$, for example, as shown in FIG. 12A. As a result, since the leakage current $I_1$ is reduced, the voltage $V_{pix}$ of the liquid crystal element 16 is increased compared with the case where the voltage of the common connection line COM in the holding period $T_h$ is adjusted to the voltage $V_{cent}$, for example, as shown in FIG. 13.

Figure 14:
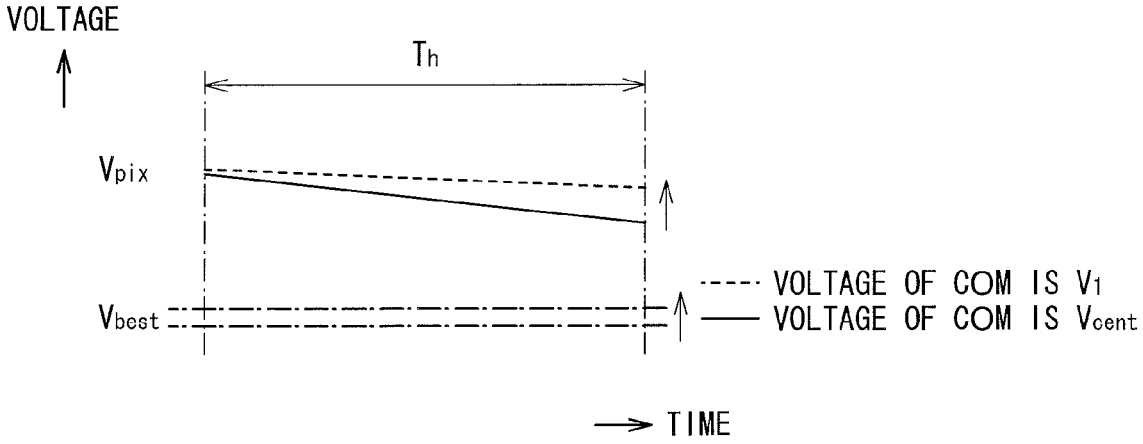
FIG. 14 is a waveform diagram for illustrating voltage applied to a liquid crystal element in the case that the leakage current in FIG. 9A occurs.

For example, in the $V_L$ frame period, the voltage of the common connection line COM is adjusted to the voltage $V_1$ in the holding period $T_h$. Thus, the voltage $V_{pix}$ of the liquid crystal element 16 is reduced compared with a case where the voltage of the common connection line COM in the holding period $T_h$ is adjusted to the voltage $V_{cent}$, for example, as shown in FIG. 12B. As a result, since the leakage current $I_1$ is reduced, the voltage $V_{pix}$ of the liquid crystal element 16 is increased compared with the case where the voltage of the common connection line COM in the holding period $T_h$ is adjusted to the voltage $V_{cent}$, for example, as shown in FIG. 14.

Figure 15:
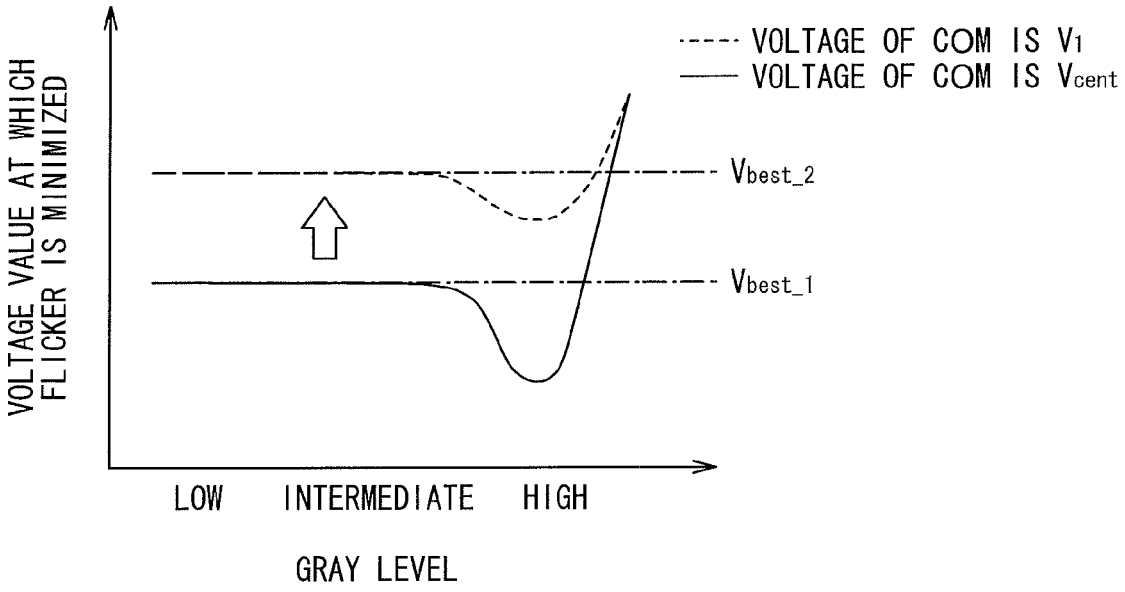
FIG. 15 is a conceptual diagram for illustrating a voltage value at which flicker is minimized.

In this way, in the embodiment, voltage of the common connection line COM in the holding period $T_h$ is adjusted to the voltage $V_1$ lower than the voltage $V_{cent}$. Thus, a voltage value (optimum value $V_{best}$), at which flicker is minimized, is increased in the holding period $T_h$ (see FIGS. 13 and 14). The optimum value $V_{best}$ is an optimum value in an intermediate gray level as shown in FIG. 15. In the case that the voltage of the common connection line COM in the holding period $T_h$ is adjusted to the voltage $V_{cent}$, an optimum value $V_{best\text{-}1}$ is far from an optimum value in a high gray level. In contrast, in the case that the voltage of the common connection line COM in the holding period $T_h$ is adjusted to the voltage $V_1$, an optimum value $V_{best\text{-}2}$ is similar to the optimum value in a high gray level. Therefore, a center value ((upper limit value (voltage $V_H$)+lower limit value (voltage $V_L$))/2) of voltages applied to the common connection lines COM in the write period $T_w$ is adjusted to the optimum value $V_{best\text{-}2}$, thereby flicker may be reduced in all display gray levels.

Thus, in the embodiment, respective values of the voltages $V_H$ and $V_L$ are adjusted in production (shipment) of the liquid crystal device 1 such that the center value ((upper limit value (voltage $V_H$)+lower limit value (voltage $V_L$))/2) of voltages applied to the common connection lines COM in the write period $T_w$ is the optimum value $V_{best\text{-}2}$. In this way, in the liquid crystal device 1 according to the embodiment, the voltage of each common connection line COM in the holding period $T_h$ is adjusted to the voltage $V_1$ lower than the voltage $V_{cent}$, thereby flicker may be easily adjusted in all display gray levels unlike in the past. This may reduce burn-in caused by flicker in a high gray level.

Second Embodiment

Next, a liquid crystal device according to a second embodiment of the invention will be described. The liquid crystal device according to the embodiment is different in configuration from the liquid crystal device 1 according to the first embodiment in that the common connection line drive circuit 35 applies multiple voltages different from one another to the common connection lines COM in the holding period $T_h$. Hereinafter, description on contents common to those in the first embodiment is omitted, and differences from the first embodiment are mainly described.

Figures 4, 5, 6, 7, 16:
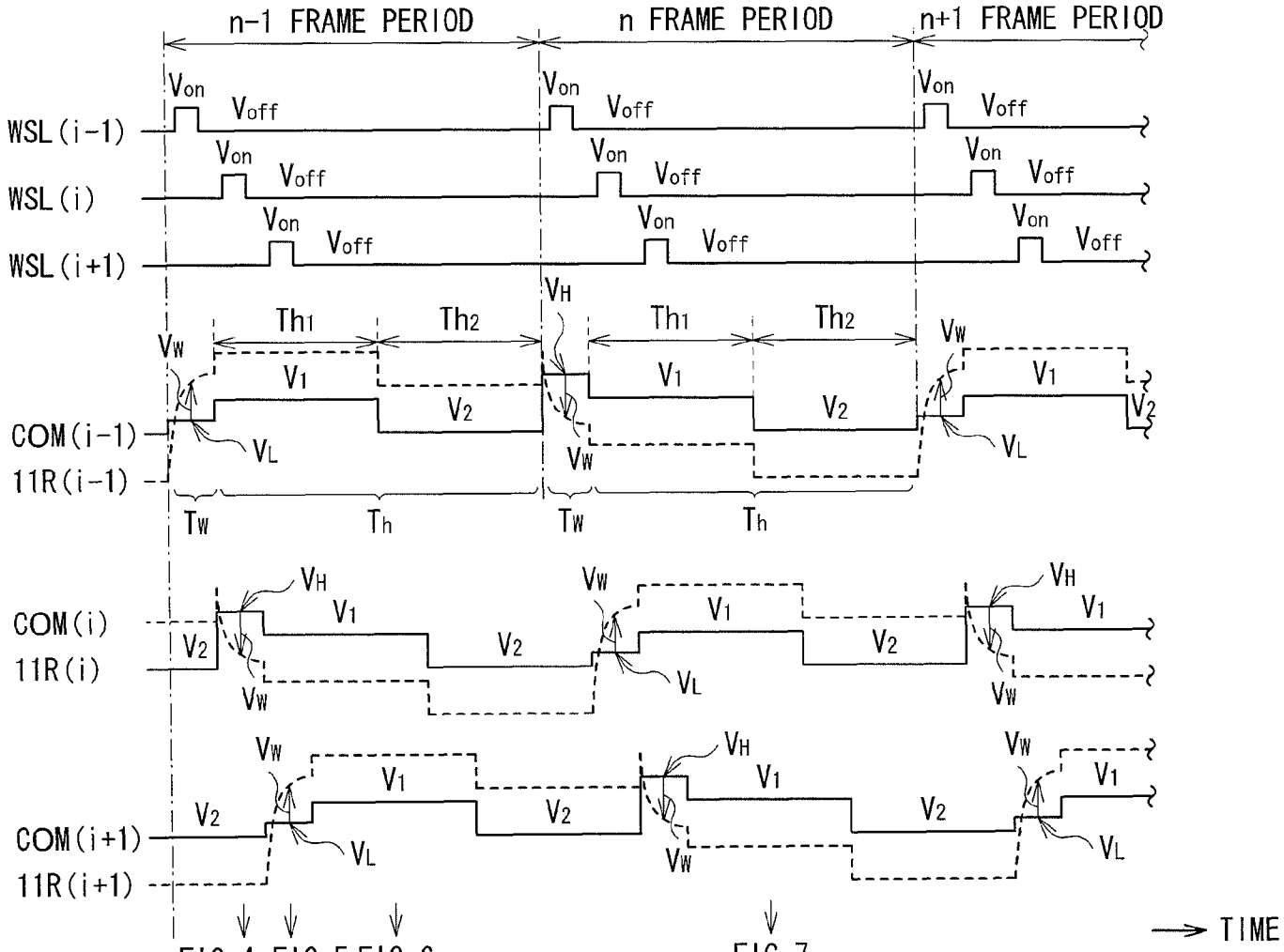
FIG. 16 is a waveform diagram showing an example of operation of a liquid crystal display device according to a second embodiment of the invention.

FIG. 16 is a timing chart showing an example of operation of the liquid crystal display device according to the embodiment. FIG. 16 shows waveforms in n−1, n, and n+1 frame periods.

Figure 17:
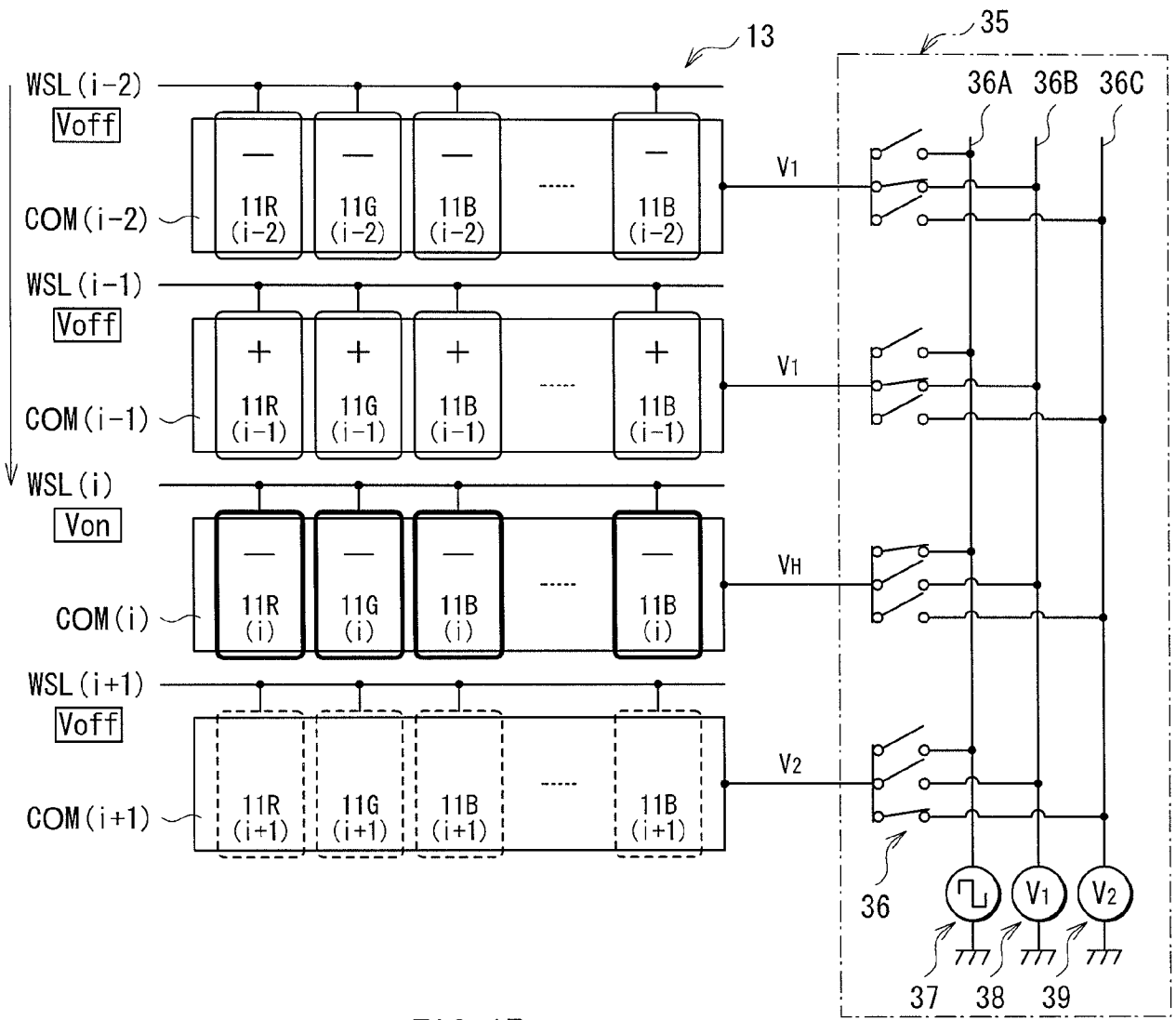
FIG. 17 is a schematic diagram showing an example of operation of the liquid crystal display device of FIG. 16.
Figure 18:
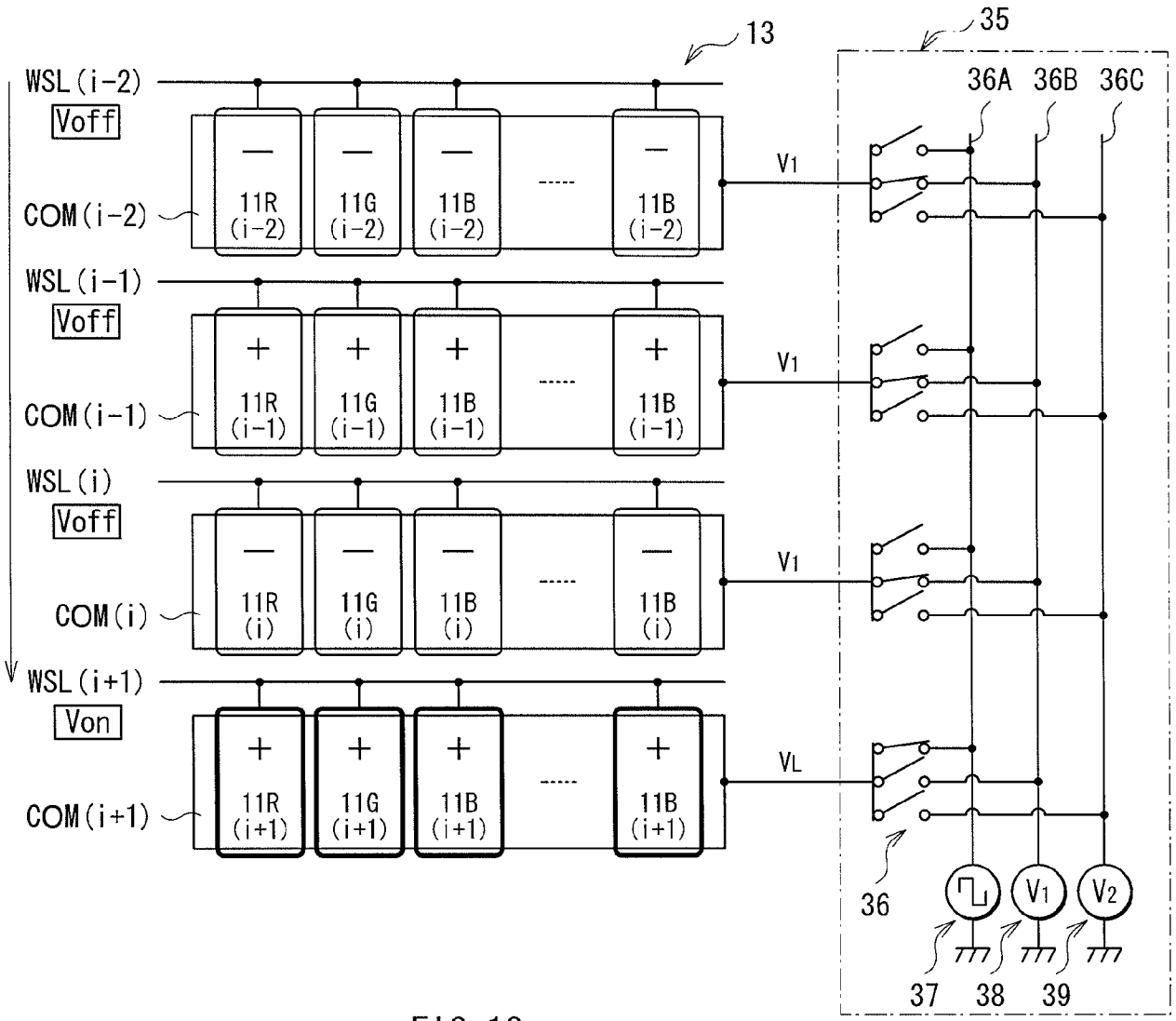
FIG. 18 is a schematic diagram showing operation following the operation of FIG. 17.

The common connection line drive circuit 35 applies multiple voltages different from one another to the common connection lines COM in the holding period $T_h$. For example, the common connection line drive circuit 35 sequentially applies two voltages $V_1$ and $V_2$ ($V_1>V_2$) in the holding period $T_h$ as shown in FIGS. 16 to 18. Each of the voltages $V_1$ and $V_2$ has a value different from a center value (voltage $V_{cent}$) between an upper limit value ($V_H$) and a lower limit value ($V_L$) of voltages ($V_L$ and $V_H$) applied to the common connection lines COM in the write period $T_w$ like the voltage $V_1$ in the first embodiment. Each of the voltage $V_1$ and $V_2$ has a value smaller than a value of the voltage $V_{cent}$, and larger than the lower limit value ($V_L$) like the voltage $V_1$ in the first embodiment.

The common connection line drive circuit 35 electrically connects common connection lines COM applied with the same voltage to each other in the holding period $T_h$. For example, as shown in FIGS. 16 and 18, the common connection line drive circuit 35 electrically connects common connection lines COM(i) and COM(i+1), which are applied with the voltage $V_1$ to each other, among a plurality of common connection lines COM disposed in correspondence to sub pixels 11 as a non-selection object in the holding period $T_h$. Moreover, for example, as shown in FIGS. 16 and 18, the common connection line drive circuit 35 electrically connects common connection lines COM(i−2) and COM(i−1), which are applied with the voltage $V_2$ to each other, among the plurality of common connection lines COM disposed in correspondence to the sub pixels 11 as a non-selection object in the holding period $T_h$. The voltage $V_1$ is preferably not significantly different from the voltage $V_2$.

The common connection line drive circuit 35 electrically isolates a common connection line COM disposed in correspondence to a sub pixel 11 as a selection object from a plurality of common connection lines COM disposed in correspondence to sub pixels 11 as a non-selection object in the holding period $T_h$. For example, as shown in FIGS. 16 and 18, the common connection line drive circuit 35 electrically isolates a common connection line COM(i+1) applied with the voltage $V_L$ from common connection lines COM(i−2), COM (i−1) and COM(i) applied with the voltage $V_1$ in the holding period $T_h$. In addition, the common connection line drive circuit 35 electrically isolates common connection lines COM applied with different voltages from one another among the plurality of common connection lines COM, which are disposed in correspondence to the sub pixels 11 as a non-selection object, in the holding period $T_h$. For example, as shown in FIGS. 16 and 18, the common connection line drive circuit 35 electrically isolates the common connection lines COM(i) and COM(i+1) applied with the voltage $V_1$ from the common connection lines COM(i−2) and COM(i−1) applied with the voltage $V_2$ in the holding period $T_h$.

Figure 19:
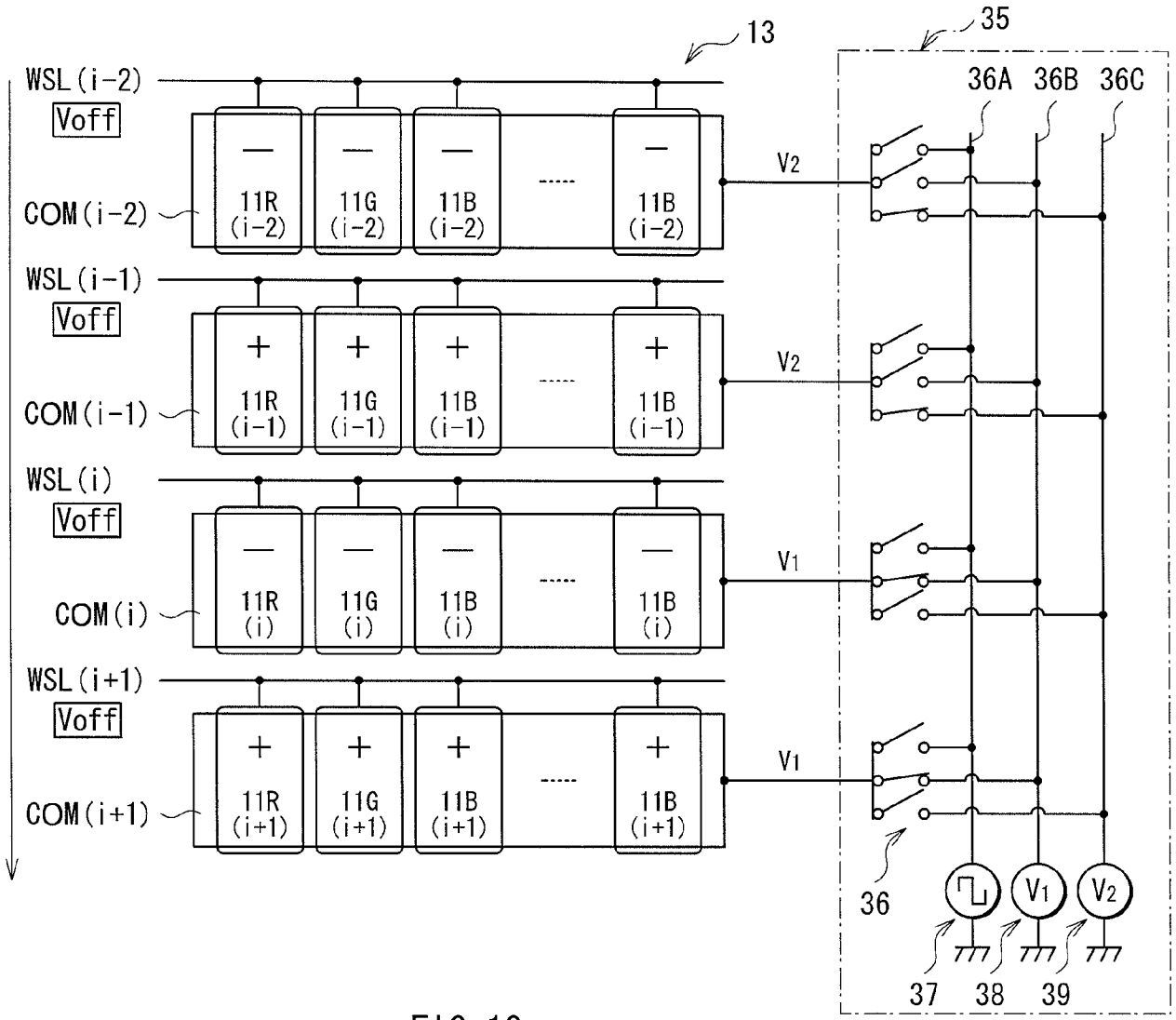
FIG. 19 is a schematic diagram showing operation following the operation of FIG. 18.
Figure 20:
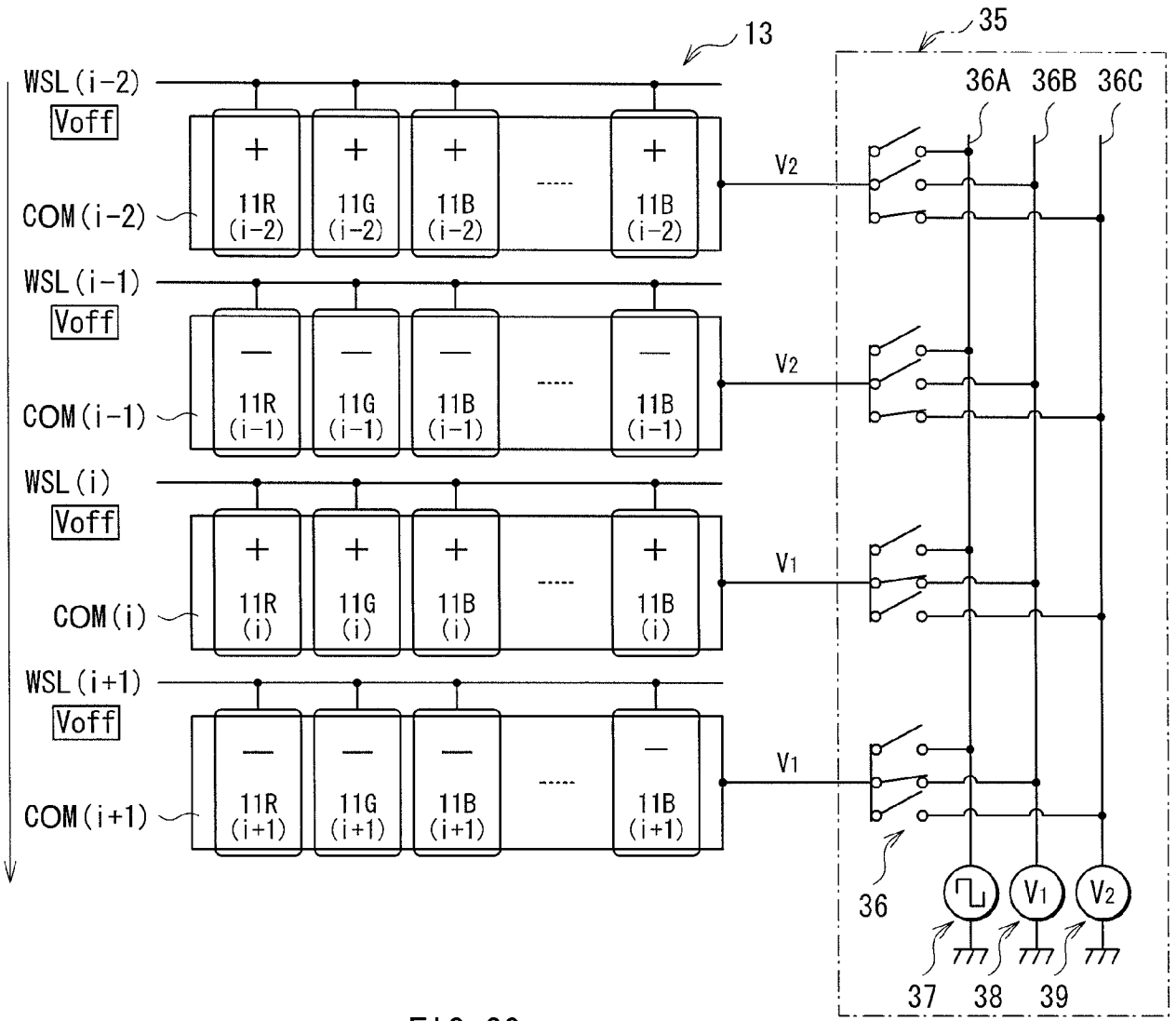
FIG. 20 is a schematic diagram showing another example of operation of the liquid crystal display device of FIG. 16.

Furthermore, in the embodiment, while the signal line drive circuit 33 performs frame reversal drive, the common connection line drive circuit 35 performs common reversal drive, in which polarity of voltages supplied to the common electrode (common connection lines COM) is reversed every frame period, as shown in FIGS. 16, 18 and 20. For example, as shown in FIGS. 19 and 20, the common connection line drive circuit 35 reverses polarity of a voltage applied to each sub pixel 11 such that polarity of a sub pixel 11 after a lapse of an n−1 frame period is opposite to polarity of a sub pixel 11 after a lapse of an n frame period.

Figure 21:
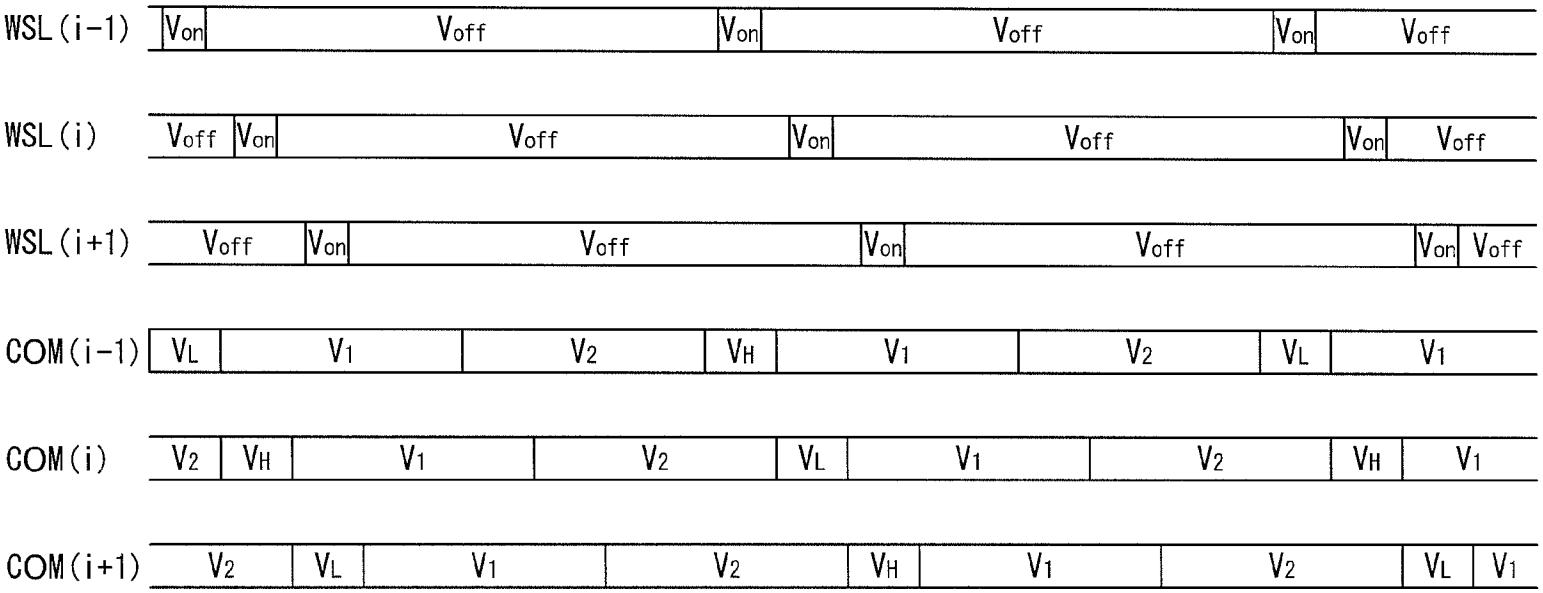
FIG. 21 is a state diagram showing the operation represented by the waveform diagram of FIG. 16.
Figure 22:
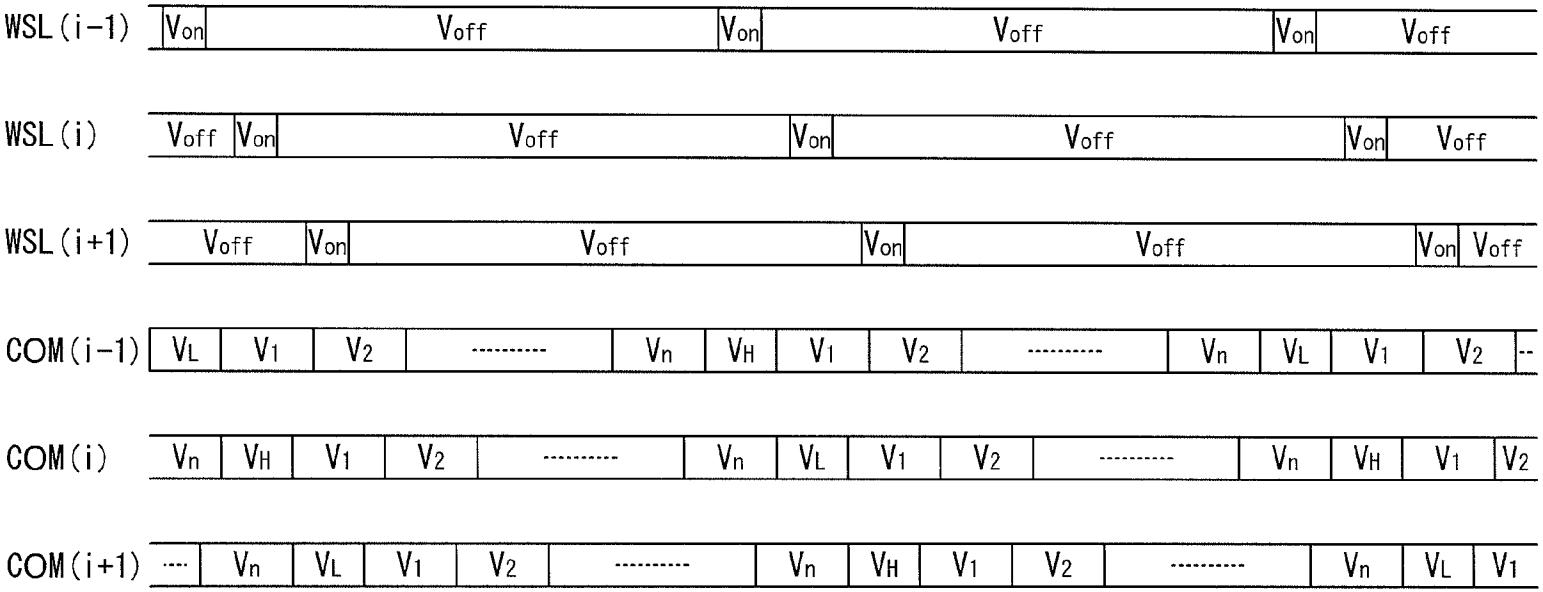
FIG. 22 is a state diagram showing a first modification of the operation of the liquid crystal display device of FIG. 16.

Voltages in the holding period $T_h$ are preferably the same between the frame periods. For example, as shown in FIG. 16, voltages in the holding period $T_h$ are preferably the same between a frame period ($V_H$ frame period) where $V_H$ is applied in the write period $T_w$ and a frame period ($V_L$ frame period) where $V_L$ is applied in the write period $T_w$. The number of voltages in the holding period $T_h$ may be two as shown in FIG. 21, or may be at least three as shown in FIG. 22. FIG. 21 represents a waveform diagram of FIG. 16 in a form of a state diagram. Similarly, FIG. 22 represents a waveform diagram in a form of a state diagram.

Figure 23:
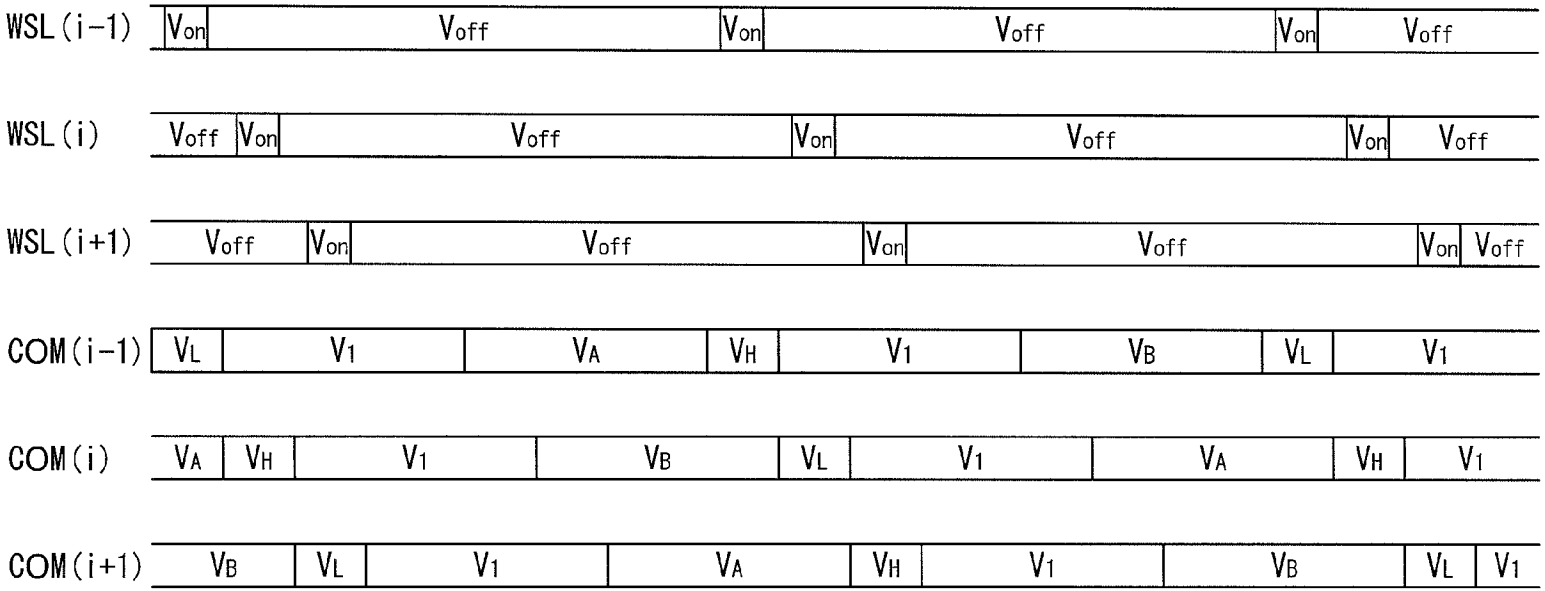
FIG. 23 is a state diagram showing a second modification of the operation of the liquid crystal display device of FIG. 16.

The voltages in the holding period $T_h$ may not be the same during all frame periods. For example, voltages may be different from each other between the $V_H$ frame period and the $V_L$ frame period. Specifically, it is acceptable that two voltages are sequentially applied in the holding period $T_h$, and a second voltage $V_B$ in a holding period $T_h$ of a $V_H$ frame period is different from a second voltage $V_A$ in a holding period $T_h$ of a $V_L$ frame period as shown in FIG. 23. In such a case, a first voltage $V_1$ in the holding period $T_h$ of the $V_H$ frame period may be equal to or different from a first voltage $V_1$ in the holding period $T_h$ of the $V_L$ frame period.

Figure 24:
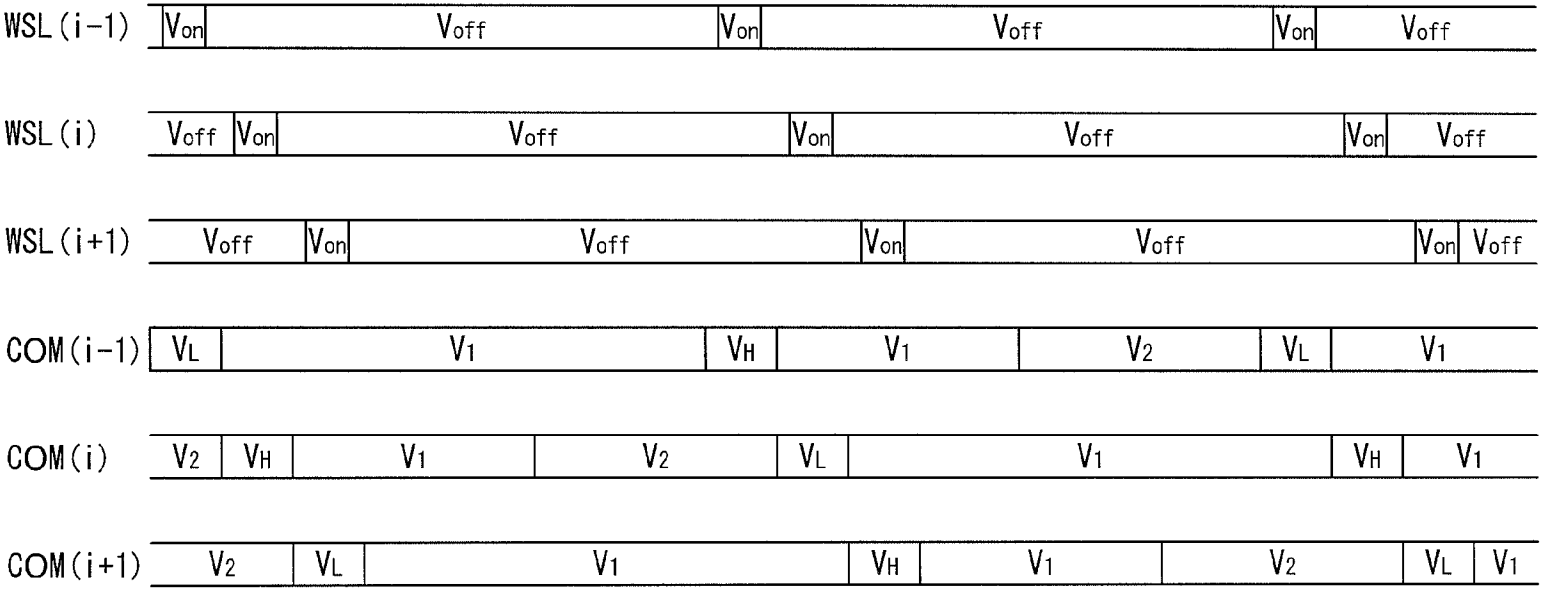
FIG. 24 is a state diagram showing a third modification of the operation of the liquid crystal display device of FIG. 16.
Figure 25:
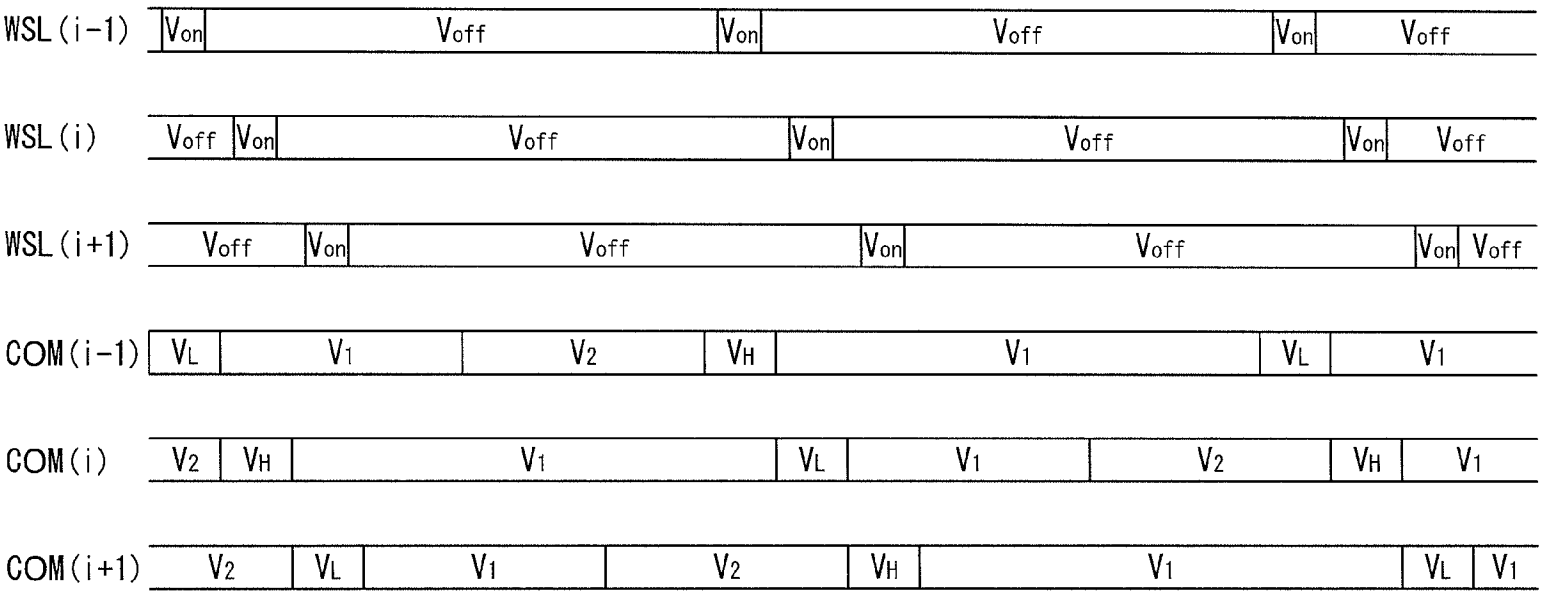
FIG. 25 is a state diagram showing a fourth modification of the operation of the liquid crystal display device of FIG. 16.

The number of voltages in the holding period $T_h$ may not be the same during all frame periods. For example, in the case that the transistors 14 and 15 are a p-type transistor, it is acceptable that two voltages ($V_1$ and $V_2$) are sequentially applied in the holding period $T_h$ of the $V_H$ frame period, and one voltage ($V_1$) is applied in the holding period $T_h$ of the $V_L$ frame period as shown in FIG. 24. In such a case, a voltage applied in the holding period $T_h$ of the $V_L$ frame period may be equal to a first voltage in the holding period $T_h$ of the $V_H$ frame period. In addition, for example, in the case that the transistors 14 and 15 are an n-type transistor, it is acceptable that one voltage ($V_1$) is applied in the holding period $T_h$ of the $V_H$ frame period, and two voltages ($V_1$ and $V_2$) are sequentially applied in the holding period $T_h$ of the $V_L$ frame period as shown in FIG. 25. In such a case, a voltage ($V_1$) applied in the holding period $T_h$ of the $V_L$ frame period may be equal to a first voltage ($V_1$) in the holding period $T_h$ of the $V_H$ frame period.

Figure 26:
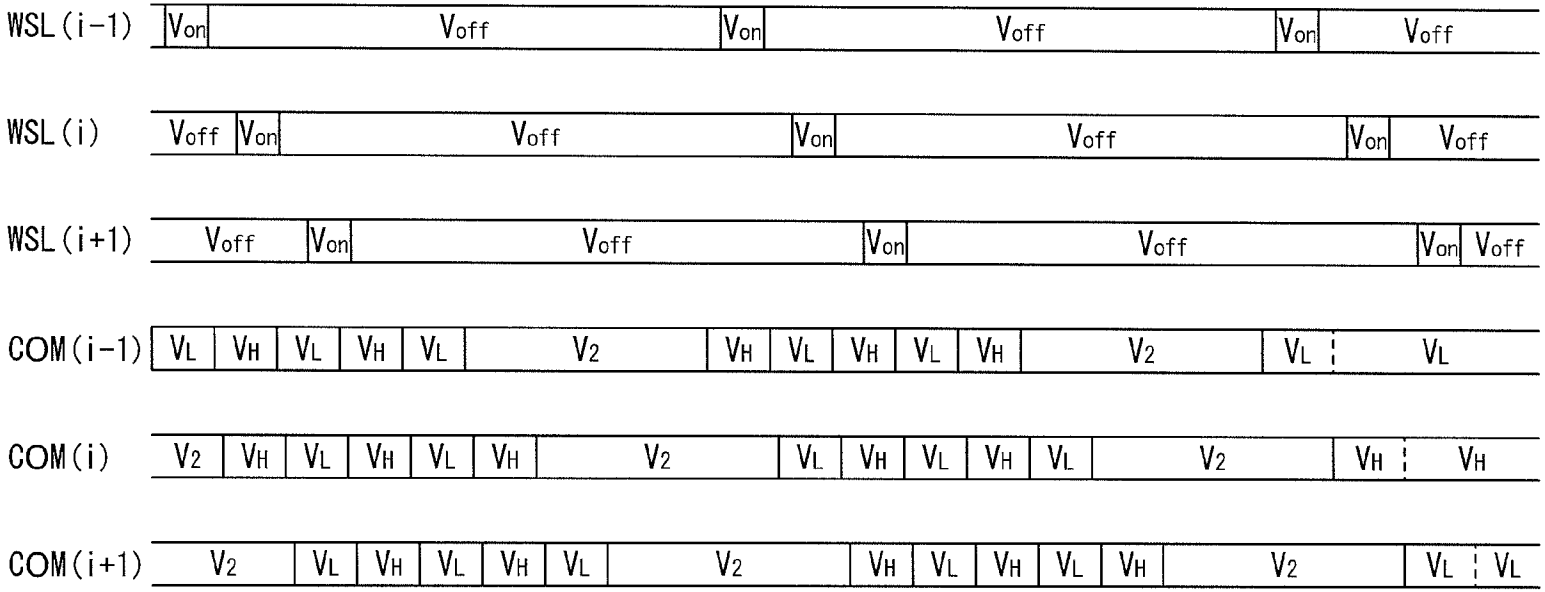
FIG. 26 is a state diagram showing a fifth modification of the operation of the liquid crystal display device of FIG. 16.

When multiple voltages exist in the holding period $T_h$, voltages equal to voltages ($V_H$ and $V_L$) applied in the writing period $T_w$ may be applied in an AC manner (alternately) at the beginning of the holding period $T_h$. For example, as shown in FIG. 26, voltages may be applied in order of $V_H$, $V_L$, $V_H$, $V_L$ . . . at the beginning of the holding period $T_h$ of the $V_H$ frame period, and voltages may be applied in order of $V_L$, $V_H$, $V_L$, $V_H$ . . . at the beginning of the holding period $T_h$ of the $V_L$ frame period.

Figure 27:
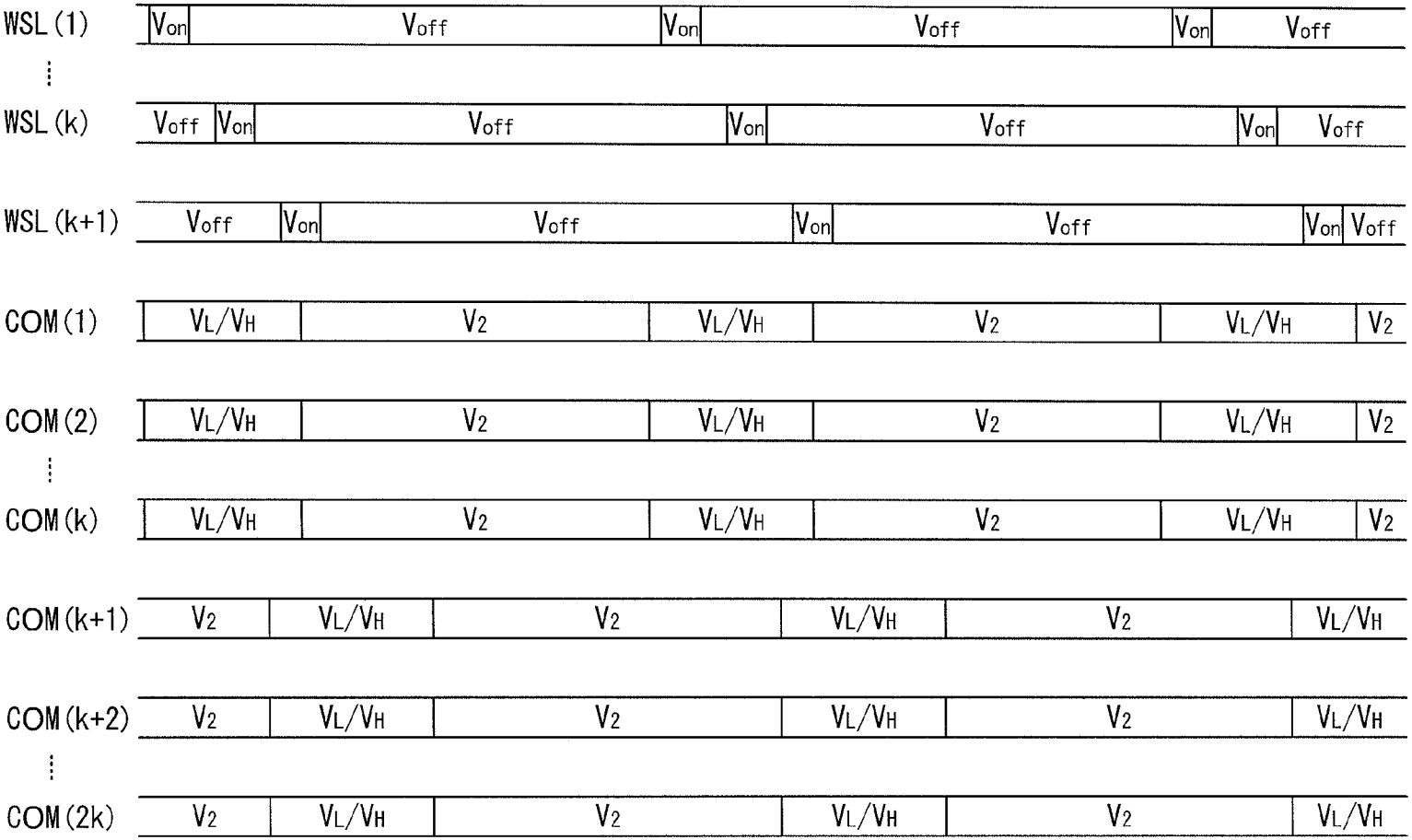
FIG. 27 is a state diagram showing a sixth modification of the operation of the liquid crystal display device of FIG. 16.

In addition, when multiple voltages exist in the holding period $T_h$, application timings of the voltages in the holding period $T_h$ may be shifted from one another by 1H every one line within one field period, for example, as shown in FIG. 16. Moreover, when multiple voltages exist in the holding period $T_h$, application timings of the voltages in the holding period $T_h$ may be synchronized with one another by k lines (k is a positive integer) within one field period, for example, as shown in FIG. 27. At that time, scan timings are preferably shifted by 1H*k from one another by k lines. In addition, the common connection line drive circuit 35 preferably sequentially applies the same voltages ($V_2$) to a plurality of common connection lines COM while being shifted by 1H*k by desired number of lines as a unit (by k lines) in the holding period $T_h$ of a predetermined frame period. In the case that timings at which voltages in the holding period $T_h$ are synchronized with one another by k lines, it is preferable that a first voltage in the holding period $T_h$ is $V_H$ in the $V_H$ frame period, and a first voltage in the holding period $T_h$ is $V_L$ in the $V_L$ frame period.

Figure 28:
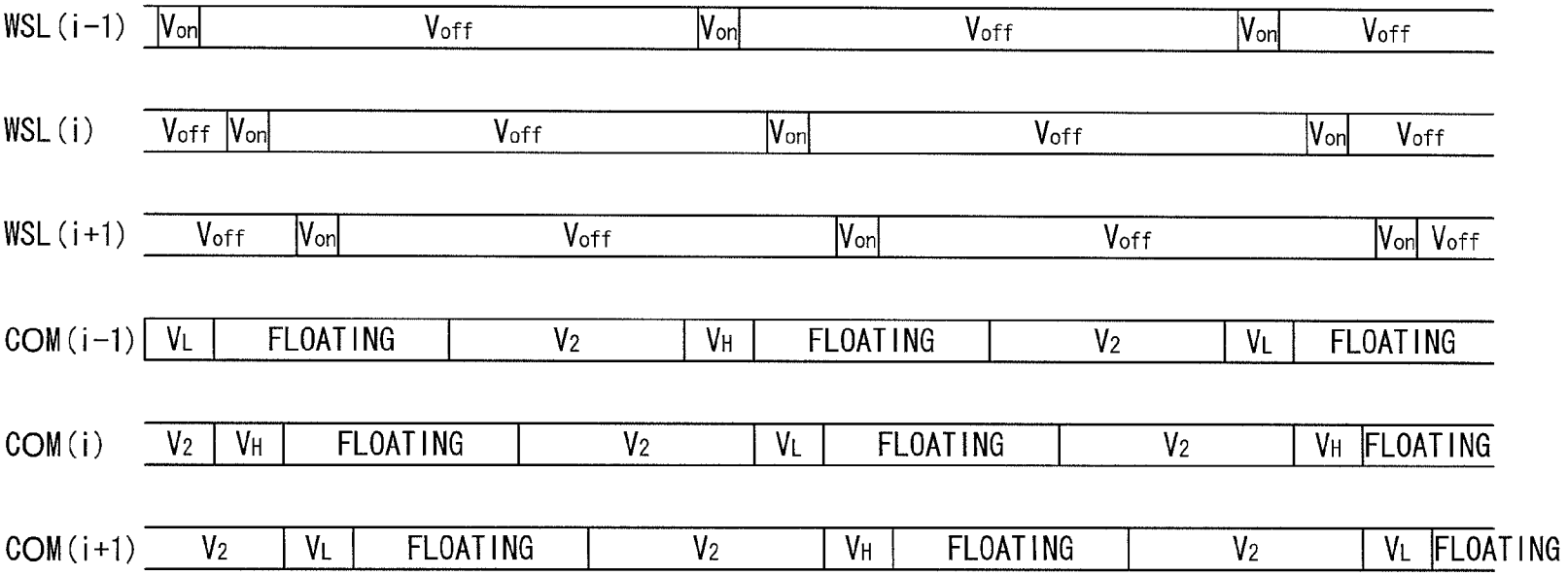
FIG. 28 is a state diagram showing a seventh modification of the operation of the liquid crystal display device of FIG. 16.

In particular, for a natural image, when multiple voltages exist in the holding period $T_h$, one voltage may be a floating voltage. This is because even if one voltage is a floating voltage, degradation in image quality is hardly viewed in the natural image. For example, as shown in FIG. 28, a first voltage in the holding period $T_h$ may be a floating voltage. However, in this case, since the common connection line COM tends to be brought into coupling with another line (for example, signal line DTL) voltage of the common connection line COM waves due to the coupling, for example, as shown in FIG. 28. In such a case, common connection lines COM being floated are connected to one another by the common connection line drive circuit 35 as will be described later. Thus, a common connection line COM is floated, thereby charges held by the common connection line COM immediately before being floated are distributed to other common connection lines COM that have been floated. As a result, voltage of each of the common connection lines COM being floated converges into a predetermined voltage (for example, voltage equivalent to the voltage $V_1$) while waving.

Figure 30:
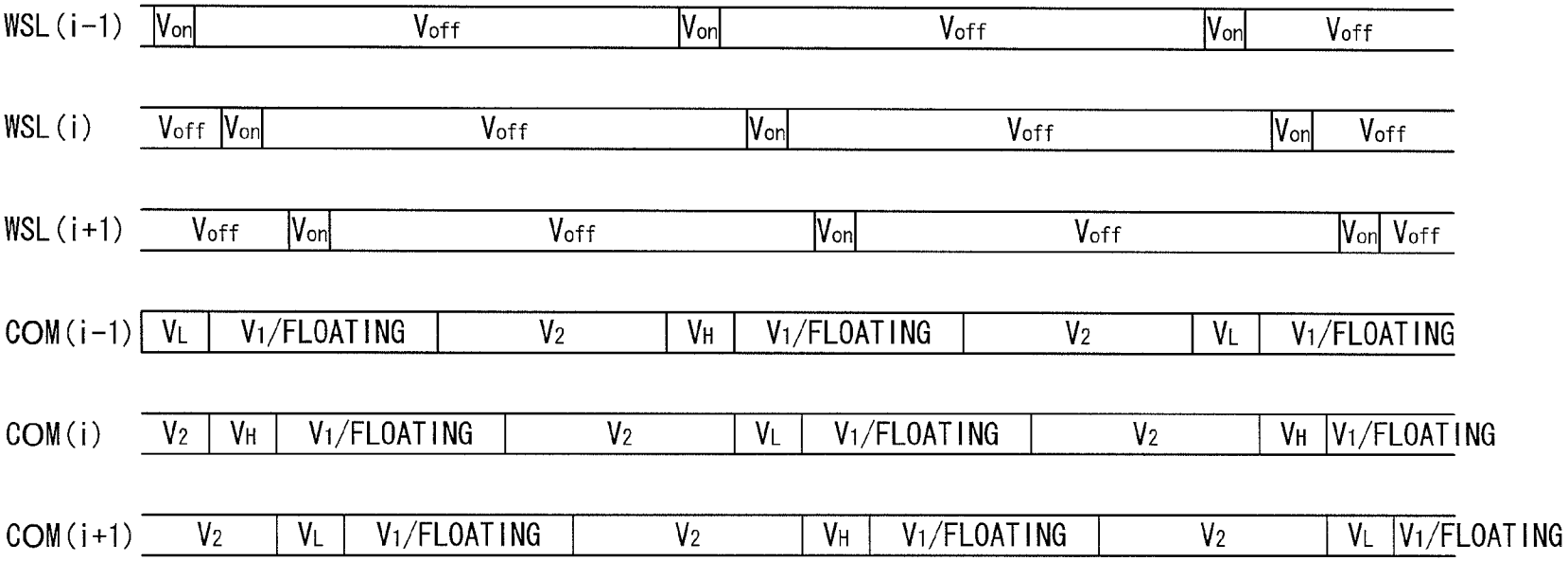
FIG. 30 is a state diagram showing a ninth modification of the operation of the liquid crystal display device of FIG. 16.
Figure 31:
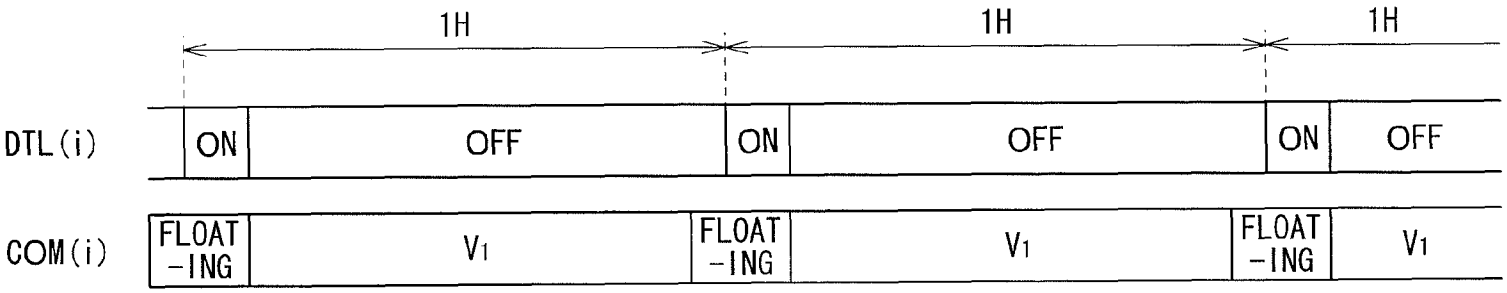
FIG. 31 is a diagram showing the state diagram of FIG. 30 in detail.

For example, the predetermined voltage $V_1$ and a floating voltage may be alternately applied to a common connection line COM in the first half of the holding period $T_h$. For example, in a 1H period, it is acceptable that a voltage in an ON period (or a period including the ON period), in which a signal voltage corresponding to a video signal 30A is applied from the video signal processing circuit 31 to a signal line DTL (i), is the floating voltage, and a voltage in another period is $V_1$, as shown in FIGS. 30 and 31. The ON period may include a period in which a precharge voltage is applied to the signal line DTL (i).

Next, an internal configuration of the common connection line drive circuit 35 will be described. Hereinafter, description is made on an example of an internal configuration in the case that two voltages exist in the holding period $T_h$.

The common connection line drive circuit 35 has switching elements 36 each of which is electrically connected to each common connection line COM, for example, as shown in FIG. 17. Each switching element 36 is provided for each common connection line COM, and has, for example, three output terminals. A first output terminal of the switching element 36 is connected to a wiring 36A, and connected to an output terminal of a pulse generator 37 via a wiring 36A. A second output terminal of the switching element 36 is connected to a wiring 36B. For example, the wiring 36B is connected to an output terminal of a constant voltage supply 38 as shown in FIG. 17. The constant voltage supply 38 outputs a predetermined voltage $V_1$ to the wiring 36B. A third output terminal of the switching element 36 is connected to a wiring 36C. For example, the wiring 36C is connected to an output terminal of a constant voltage supply 39 as shown in FIG. 17. The constant voltage supply 39 outputs a predetermined voltage $V_2$ ($<V_1$) to the wiring 36C.

The common connection line drive circuit 35 connects a common connection line COM, which is disposed in correspondence to a horizontal line including a sub pixel 11 (as a selection object) being on through application of $V_{on}$ to a scan line WSL, to an output terminal of the pulse generator 37. For example, as shown in FIG. 17, the common connection line drive circuit 35 connects a common connection line COM(i), which is disposed in correspondence to a row including sub pixels 11R(i), 11G(i) and 11B(i) as a selection object, to output of the pulse generator 37 via the switching element 36 and the wiring 36A so that voltage of the line COM(i) is $V_H$. In addition, for example, as shown in FIG. 18, the common connection line drive circuit 35 connects a common connection line COM(i+1), which is disposed in correspondence to a row including sub pixels 11R(i+1), 11G(i+1) and 11B(i+1)

as a selection object, to output of the pulse generator 37 via the switching element 36 and the wiring 36A so that voltage of the line COM(i+1) is $V_L$.

The common connection line drive circuit 35 connects a common connection line COM to the wiring 36B, the common connection line COM being disposed in correspondence to a horizontal line, where a predetermined non-selection time has not elapsed, until the predetermined time passes among a plurality of horizontal lines including sub pixels 11 (as a non-selection object) being off through application of a voltage $V_{off}$ to scan lines WSL. For example, as shown in FIGS. 16 and 18, the common connection line drive circuit 35 connects common connection lines COM(i−2), COM(i−1) and COM(i), which are disposed in correspondence to three rows including sub pixels 11R(i−2), 11R(i−1) and 11R(i) as a non-selection object, to the wiring 36B via the switching elements 36 so that voltage of each line is $V_1$.

Furthermore, the common connection line drive circuit 35 connects a common connection line COM to the wiring 36C, the common connection line COM being disposed in correspondence to a horizontal line, in which a predetermined non-selection time has elapsed, among the plurality of horizontal lines including sub pixels 11 (as a non-selection object) being off through application of the voltage $V_{off}$ to scan lines WSL. For example, as shown in FIGS. 16 and 19, the common connection line drive circuit 35 connects the common connection lines COM(i−2) and COM(i−1), which are disposed in correspondence to two rows including the sub pixels 11R(i−2) and 11R(i−1) as a non-selection object, to the wiring 36C via the switching elements 36 so that voltage of each line is $V_2$.

When at least three voltages exist in the holding period $T_h$, while not shown, it is enough that the common connection line drive circuit 35 has, for example, the following configuration. That is, it is enough that the common connection line drive circuit 35 has, for example, switching elements 36, a pulse generator 37, at least three types of constant voltage circuits, a wiring 36A connected to the pulse generator 37, and wirings connected to the respective constant voltage circuits.

Figure 32:
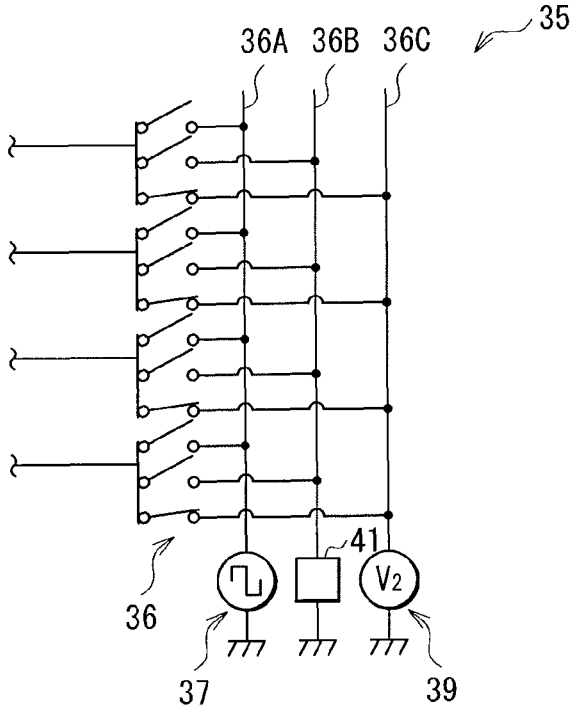
FIG. 32 is a configuration diagram showing an example of a common connection line drive circuit of the liquid crystal display device of FIG. 16.

The common connection line drive circuit 35 may have a logic circuit in place of the constant voltage supplies 38 and 39. For example, the common connection line drive circuit 35 may have a logic circuit 41 in place of the constant voltage supply 38 as shown in FIG. 32. In addition, while not shown, another common connection line drive circuit 35, may be additionally provided on the other ends of the common connection lines COM.

Figure 33:
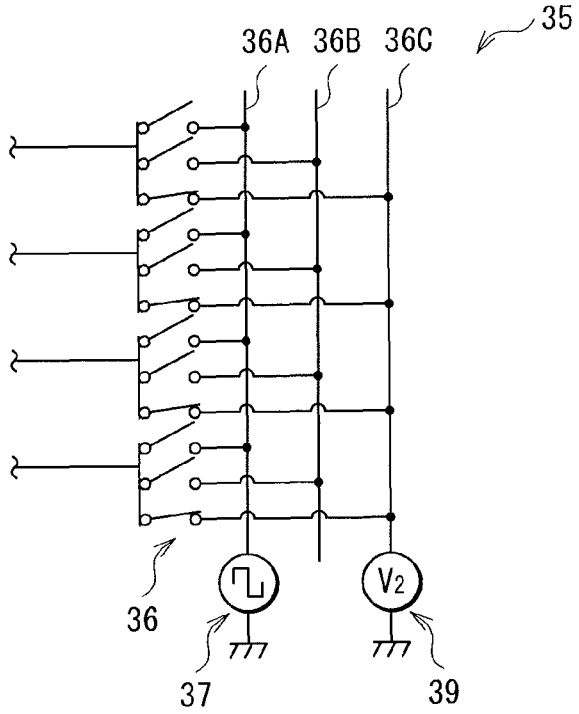
FIG. 33 is a configuration diagram showing a first modification of the common connection line drive circuit of the liquid crystal display device of FIG. 16.
Figure 34:
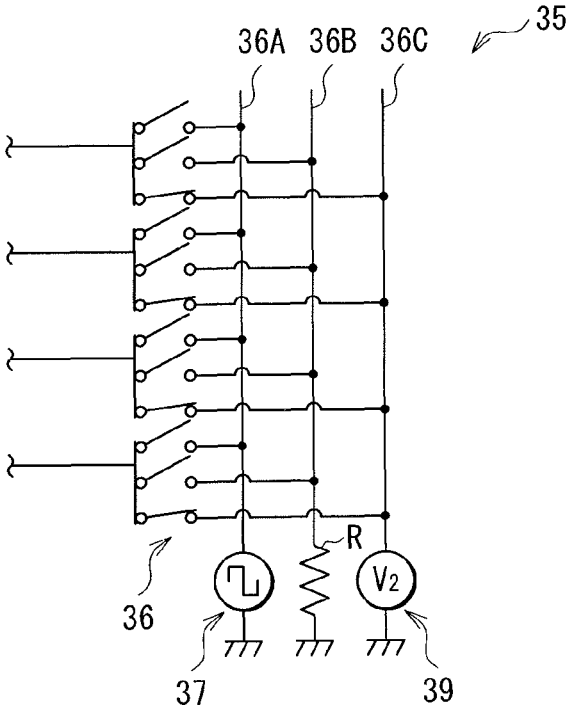
FIG. 34 is a configuration diagram showing a second modification of the common connection line drive circuit of the liquid crystal display device of FIG. 16.

In the case that multiple voltages exist in the holding period $T_h$, when one of the voltages is a floating voltage, it is enough that the common connection line drive circuit 35 has, for example, the following configuration. That is, for example, as shown in FIG. 33, it is enough that the common connection line drive circuit 35 has switching elements 36, a pulse generator 37, a constant voltage supply 39, a wiring 36A connected to the pulse generator 37, a wiring 36B in a floating state, and a wiring 36C connected to the constant voltage supply 39. Alternatively, for example, the common connection line drive circuit 35 may have a high resistance R between the wiring 36B in a floating state and ground. In such a case, the wiring 36B may be substantially regarded to be floated.

Next, operation of the liquid crystal display device according to the embodiment will be described. Hereinafter, description is made on operation in the case that two voltages exist in the holding period $T_h$.

Write Period $T_w$

In a write period $T_w$ as the first half of each frame period, the scan line drive circuit 34 applies a voltage $V_{on}$ to a plurality of scan lines WSL in a desired number of lines as a unit, so that the transistors 14 and 15 are turned on. Furthermore, the signal line drive circuit 33 applies a signal voltage $V_{sig}$ to each signal line DTL, and the common connection line drive circuit 35 applies the signal voltage $V_L$ or $V_H$ to a common connection line COM corresponding to a sub pixel 11 as a selection object.

At that time, the signal line drive circuit 33 applies a signal voltage $V_{sig}$, of which the polarity is reversed every 1H period, and reversed every frame period with respect to a reference voltage $V_{ref}$, to each signal line DTL (1H reversal drive and frame reversal drive). Furthermore, the common connection line drive circuit 35 applies a voltage, of which the polarity with respect to the reference voltage $V_{ref}$ is opposite to polarity of the signal line DTL with respect to the reference voltage $V_{ref}$, to a common connection line COM corresponding to a sub pixel 11 as a selection object in the write period $T_w$ of each frame period (common reversal drive). Thus, a voltage $V_w$ corresponding to the signal voltage $V_{sig}$ is written into the sub pixel 11 as a selection object in the write period $T_w$ (see FIG. 16). In the embodiment, the voltage $V_w$ is written with the 1H reversal drive, the frame reversal drive and the common reversal drive. This may reduce amplitude of a signal voltage applied to the sub pixel 11, and thus power consumption may be controlled to be low.

Holding Period $T_h$

In a holding period $T_h$ as the second half of each frame period, the scan line drive circuit 34 applies the voltage $V_{off}$ to scan lines WSL corresponding to sub pixels 11 as a non-selection object so that transistors 14 and 15 are turned off. Thus, the voltage $V_w$ written during the write period $T_w$ is kept in each of the sub pixels 11 as a non-selection object. As a result, each sub pixel 11 is lighted with a luminance corresponding to the voltage $V_w$.

The voltage $V_w$ is principally not easily kept during the holding period $T_h$. For example, in the $V_H$ frame period, as shown in FIGS. 2 and 8A, when the transistors 14 and 15 are turned off, a voltage $V_{mid}$ of an intermediate node as a connection point between the transistors 14 and 15 is brought into coupling to be pulled in a negative direction. Thus, since the voltage $V_{mid}$ becomes similar to off voltage of the transistors 14 and 15, a leakage current $I_1$ flows from a liquid crystal element 16 to the transistors 14 and 15 side. Immediately after writing in the $V_H$ frame period, since a voltage $V_{pix}$ of the liquid crystal element 16 is lower than an average value (voltage $V_{sig\text{-}ave}$) of voltages of signal lines DTL reversed in polarity every 1H, a leakage current $I_2$ flows from the signal line DTL to the transistors 14 and 15 side. The voltage $V_{sig\text{-}ave}$ represents the average value of voltages of the signal lines DTL reversed in polarity every 1H.

For example, in the $V_L$ frame period, as shown in FIGS. 2 and 9A, when the transistors 14 and 15 are turned off, the voltage $V_{mid}$ of the intermediate node as a connection point between the transistors 14 and 15 is brought into coupling to be pulled in a negative direction. Thus, since the voltage $V_{mid}$ becomes similar to the off voltage of the transistor 14 or 15, a leakage current $I_1$ flows from the liquid crystal element 16 to the side of the transistor 14 or 15. Immediately after writing in the $V_L$ frame period, since a voltage $V_{pix}$ of the liquid crystal element 16 is higher than an average value (voltage $V_{sig\text{-}ave}$) of voltages of signal lines DTL reversed in polarity every 1H, a leakage current $I_2$ flows from the side of the transistor 14 or 15 to the signal line DTL. The voltage $V_{sig\text{-}ave}$ represents the average value of voltages of the signal lines DTL reversed in polarity every 1H.

Therefore, for example, when the common connection line drive circuit 35 continuously applies a constant voltage to common connection lines COM corresponding to sub pixels 11 as a non-selection object in the holding period $T_h$ as shown in FIGS. 12A and 12B, the voltage $V_{pix}$ is as shown in FIGS. 12A and 12B. Specifically, in the $V_H$ frame period, the voltage $V_{pix}$ changes in a negative direction in the first half of the holding period $T_h$, and then changes in a positive direction as shown in FIG. 12A. In this way, in the $V_H$ frame period, the holding period $T_h$ has a period $T_d$, in which the voltage $V_{pix}$ changes in the negative direction, in the first half of the period, and has a period $T_u$, in which the voltage $V_{pix}$ changes in the positive direction, in the second half thereof. In contrast, in the $V_L$ frame period, the voltage $V_{pix}$ changes in a negative direction in each of the first half and the second half of the holding period $T_h$ as shown in FIG. 12B. In this way, the holding period $T_h$ has only a period $T_d$, in which the voltage $V_{pix}$ changes in the negative direction, in the $V_L$ frame period. This means that when a value of the voltage $V_1$ of the common connection line COM is adjusted, average values of written voltages $V_w$ (average values of voltages applied to the liquid crystal element 16) are hardly made to be perfectly equal to each other between the first half and the second half of the holding period $T_h$ in the $V_L$ frame period.

FIGS. 12A and 12B show waveforms in the case that the transistors 14 and 15 are an n-type transistor. In the case that the transistors 14 and 15 are a p-type transistor, the holding period $T_h$ has only the period $T_u$, in which the voltage $V_{pix}$ changes in a positive direction, in the $V_H$ frame period, and has the period $T_d$, in which the voltage $V_{pix}$ changes in the negative direction, and the period $T_u$, in which the voltage $V_{pix}$ changes in the positive direction, in the $V_L$ frame period.

Figure 35B:
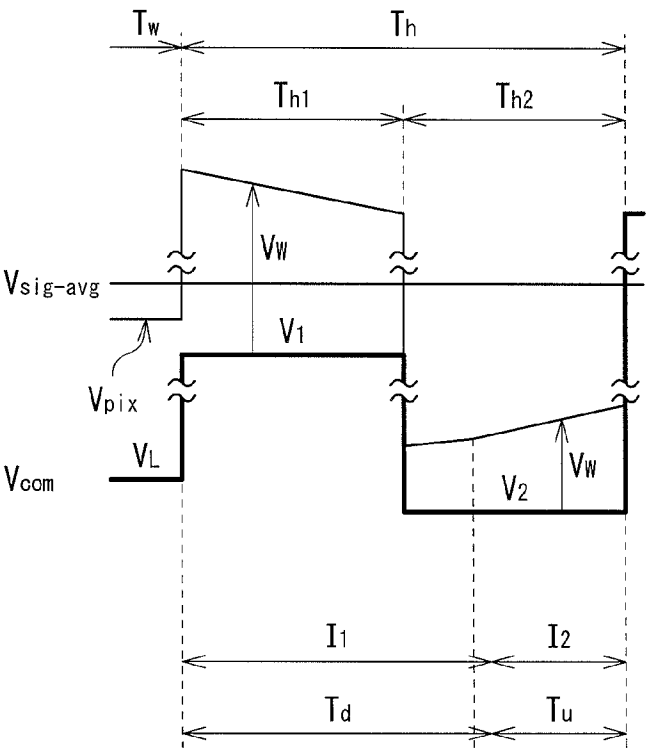
FIGS. 35A and 35B are waveform diagrams for illustrating voltage applied to a liquid crystal element in the liquid crystal display device of FIG. 16.
Figure 35A:
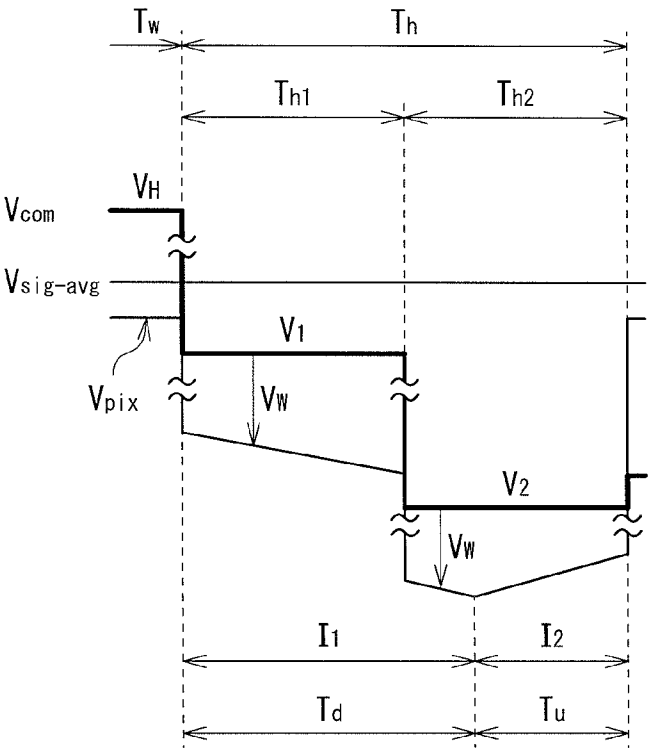

In the embodiment, for example, the common connection line drive circuit 35 applies multiple (two) voltages to common connection lines COM corresponding to sub pixels 11 as a non-selection object in the holding period $T_h$ as shown in FIG. 16. Thus, the voltage $V_{pix}$ is as shown in FIGS. 35A and 35B. Specifically, in the $V_H$ frame period, the voltage $V_{pix}$ changes in a negative direction in the first half of the holding period $T_h$, and then changes in a positive direction as shown in FIG. 35A. In this way, in the $V_H$ frame period, the holding period $T_h$ has a period $T_d$, in which the voltage $V_{pix}$ changes in the negative direction, in the first half of the period, and has a period $T_u$, in which the voltage $V_{pix}$ changes in the positive direction, in the second half thereof. Even in the $V_L$ frame period, the voltage $V_{pix}$ changes in a negative direction in the first half of the holding period $T_h$, and then changes in the positive direction as shown in FIG. 35B. In this way, even in the $V_L$ frame period, the holding period $T_h$ has the period $T_d$, in which the voltage $V_{pix}$ changes in the negative direction, in the first half of the period, and has the period $T_u$, in which the voltage $V_{pix}$ changes in the positive direction, in the second half thereof. Therefore, in the embodiment, a value of the voltage $V_1$ or $V_2$ of the common connection line COM is adjusted, or length of an application period $T_{h1}$ or $T_{h2}$ is adjusted, thereby average values of written voltages $V_w$ (average values of voltages applied to the liquid crystal element 16) may be made perfectly or substantially equal to each other between the first half and the second half of the holding period $T_h$ in each of the $V_H$ frame period and the $V_L$ frame period.

In other words, in the embodiment, the sub pixels 11 are driven such that the holding period $T_h$ of each frame period has a period ($T_d$) in which voltage of one liquid crystal element 16 decreases, and a period ($T_u$) in which the voltage increases. Furthermore, multiple (two) voltages are applied to a plurality of common connection lines COM such that average values of voltages applied to the liquid crystal element 16 are equal to each other between a period ($T_{h1}$) in which one voltage ($V_1$) is applied and a period ($T_{h2}$) in which the other voltage ($V_2$) is applied.

Thus, luminance of a sub pixel 11 may be made even between the period $T_{h1}$ and the period $T_{h2}$. As a result, flicker may be reduced. In the embodiment, since length of each frame period need not be decreased compared with previous length (namely, frame frequency need not be increased), flicker may be reduced even if high-speed drive is not performed. When high-speed drive is not performed, increase in power consumption may be suppressed in addition to reduction in flicker. Since flicker may be reduced, luminance of the backlight 20 may be increased compared with in the past. As a result, high image quality such as high contrast or high luminance may be achieved while flicker is reduced. Moreover, in the embodiment, a configuration or a shape of a sub pixel 11 is not restricted, which eliminates a possibility of reduction in aperture ratio or of increase in number of masks used in a manufacturing process.

In the embodiment, voltage of the common connection line COM in the holding period $T_h$ is adjusted to the voltage $V_1$ or $V_2$ lower than the voltage $V_{cent}$ as in the first embodiment. Thus, a voltage value (optimum value $V_{best}$), at which flicker is minimized, is increased in the holding period $T_h$ (see FIGS. 13 and 14). The optimum value $V_{best}$ is an optimum value in an intermediate gray level as shown in FIG. 15. In the case that the voltage of the common connection line COM in the holding period $T_h$ is adjusted to the voltage $V_{cent}$, an optimum value $V_{best-1}$ is far from an optimum value in a high gray level. In contrast, in the case that the voltage of the common connection line COM in the holding period $T_h$ is adjusted to the voltage $V_1$, an optimum value $V_{best-2}$ is similar to the optimum value in the high gray level. Therefore, a center value ((upper limit value (voltage $V_H$)+lower limit value (voltage $V_L$))/2) of voltages applied to the common connection lines COM in the write period $T_w$ is adjusted to the optimum value $V_{best-2}$, thereby flicker may be reduced in all display gray levels.

Thus, even in the embodiment, values of the voltages $V_H$ and $V_L$ are adjusted in production (shipment) of the liquid crystal device such that the center value ((upper limit value (voltage $V_H$)+lower limit value (voltage $V_L$))/2) of voltages applied to the common connection lines COM in the write period $T_w$ is the optimum value $V_{best-2}$. In this way, even in the liquid crystal device according to the embodiment, the voltage of each common connection line COM in the holding period $T_h$ is adjusted to the voltage $V_1$ or $V_2$ lower than the voltage $V_{cent}$, thereby flicker may be easily adjusted in all display gray levels unlike in the past. This may reduce burn-in caused by flicker in a high gray level.

In the embodiment, even if voltages of the common connection line COM in the holding period $T_h$ are the same or not the same between respective frame periods, an average values of written voltages $V_w$ may be equalized between both holding periods $T_h$ of the $V_H$ frame period and the $V_L$ frame period. In addition, even if the number of voltages of the common connection line COM in the holding period $T_h$ is not constant between all frame periods, an average value of written voltages $V_w$ may be equalized between both holding periods $T_h$ of the $V_H$ frame period and the $V_L$ frame period.

In the embodiment, a common connection line COM disposed in correspondence to a sub pixel 11 as a selection object is electrically isolated from a plurality of common connection lines COM disposed in correspondence to sub pixels 11 as a non-selection object in the holding period $T_h$. Thus, capacitance may be reduced during driving compared with a case where a common electrode is provided for all sub pixels 11. Moreover, in the embodiment, among the plurality of common connection lines COM disposed in correspondence to sub pixels 11 as a non-selection object, common connection lines COM applied with different voltages are also electrically isolated from each other in the holding period $T_h$. This prevents occurrence of voltage difference between common connection lines COM applied with the same voltages for the sub pixels 11 as a non-selection object. Thus, charge and discharge of a common connection line COM may be performed at high speed while power consumption and light slipping are controlled to be low/small.

Voltages applied in the holding period $T_h$ are preferably not significantly different from one another. In such a case, since a large transverse electric-field is not generated in a region between common connection lines COM applied with voltages different from each other, light slipping may be reduced in the region.

In the embodiment, while the signal line drive circuit 33 performs frame reversal drive, common reversal drive, in which polarity of a voltage supplied to a common electrode (common connection lines COM) is reversed every frame period, is performed as shown in FIGS. 19 and 20. Thus, since amplitude of a signal voltage applied to the sub pixel 11 may be reduced, power consumption may be further controlled to be low.

In the embodiment, for example, in the case that a common connection line COM is floated for a predetermined period as shown in FIGS. 28 to 31, wiring capacitance between a signal line DTL and a common connection line COM is drastically reduced. As a result, power consumption may be further controlled to be low.

Figures 4, 5, 6, 7, 29:
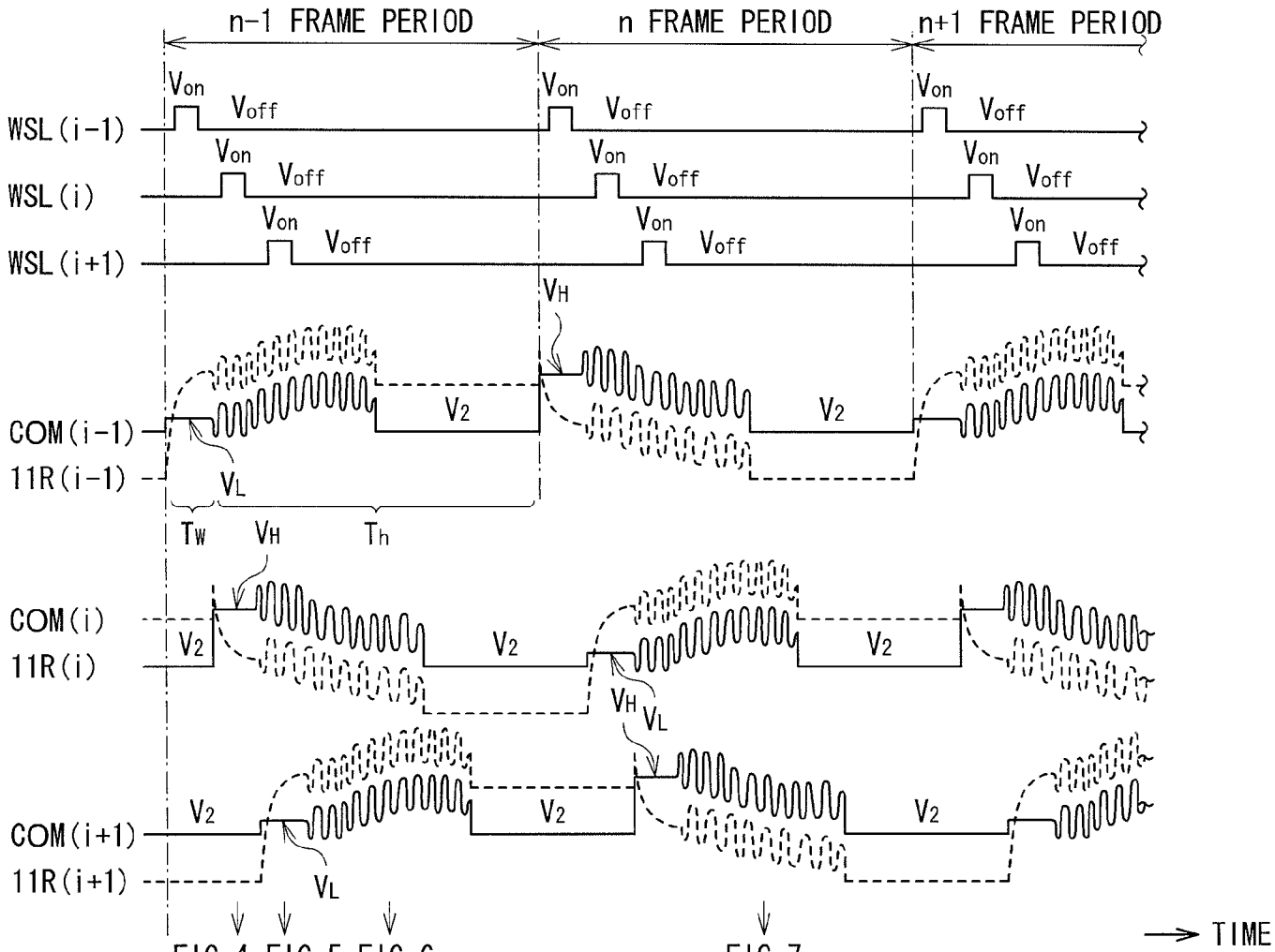
FIG. 29 is a state diagram showing an eighth modification of the operation of the liquid crystal display device of FIG. 16.

In the embodiment, for example, as shown in FIG. 32, a logic circuit 41 may be provided in place of the constant voltage supply 38 so that the logic circuit 41 controls a period, in which electric potential of a common connection line COM in a holding period is unstable due to floating, (each waving period in FIG. 29), and other periods (non-waving periods in FIG. 29). This may provide both merits of low power consumption due to floating and low noise due to constant-current source charging.

While not shown, in the case that another common connection line drive circuit 35 is additionally provided on the other end of each common connection line COM, ability of driving the common connection lines COM may be improved.

While the invention has been described with the embodiments hereinbefore, the invention is not limited to the embodiments, and may be variously modified or altered. For example, in the embodiments, while a voltage applied to the common connection line COM or an intermediate node line MID in the holding period $T_H$ has been a DC voltage in the embodiments, the voltage may be an AC voltage including a DC component.

The present application contains subject matter related to that disclosed in Japanese Priority Patent Application JP 2009-163134 filed in the Japan Patent Office on Jul. 9, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalent thereof.

What is claimed is:

1. A liquid crystal display device comprising:

a pixel array section having (i) a plurality of scan lines arranged in columns, (ii) a plurality of signal lines arranged in rows, (iii) a plurality of pixel circuits arranged in a matrix in correspondence to intersections between the plurality of scan lines and the plurality of signal lines, the plurality of pixel circuits being connected to respective scan lines and respective signal lines corresponding to the intersections, (iv) a plurality of liquid crystal elements arranged in a matrix in correspondence to the intersections, the plurality of liquid crystal elements being connected to respective pixel circuits corresponding to the intersections, and (v) a plurality of common connection lines connected to the plurality of liquid crystal elements for each row;

a scan line drive circuit that sequentially applies selection pulses to the plurality of scan lines to sequentially select the plurality of liquid crystal elements in scan lines as a unit;

a signal line drive circuit applying a signal voltage corresponding to a video signal to each signal line such that polarity of the signal voltage is reversed every frame period for writing into a liquid crystal element as a selection object; and a common connection line drive circuit that (i) applies a voltage, the voltage having a polarity opposite to a polarity of the signal line, to a common connection line corresponding to the liquid crystal element as the selection object in a write period for writing into the liquid crystal element, and (ii) applies one or more voltages, the one or more voltages being different from voltages applied to the common connection line in the write period, to the common connection line in a holding period after writing into the liquid crystal element is performed, each of the one or more voltages being lower than a center voltage having a value between an upper limit value and a lower limit value of the voltages applied to the common connection line in the write period.

2. The liquid crystal display device according to claim 1, wherein the one or more voltages are each a DC voltage.

3. The liquid crystal display device according to claim 1, wherein, in a holding period of a predetermined frame period, the common connection line drive circuit applies voltages having the same value to multiple common connection lines in a desired number of lines as a unit.

4. The liquid crystal display device according to claim wherein the one or more voltages are two voltages, and the common connection line drive circuit applies the two voltages such that average values of voltages applied to the liquid crystal element are equal to each other between a first portion of the holding period for applying one voltage and a second portion of the holding period for applying the other voltage.

5. The liquid crystal display device according to claim 1, wherein each pixel circuit includes a first transistor and a second transistor that are connected to each other, the first transistor being further connected to a respective signal line and the second transistor being further connected to a respective liquid crystal element.

6. The liquid crystal display device according to claim 5, wherein:

the first transistor has a first end and a second end, and the second transistor has a first end and a second end, the first end of the first transistor is connected to the respective signal line, the second end of the first transistor is connected to the first end of the second transistor, and the second end of the second transistor is connected to the respective liquid crystal element.

7. The liquid crystal display device according to claim 6, wherein:

the first transistor and the second transistor are field-effect thin film transistors, each first and second end of the respective transistor is one of a source and a drain and a gate of the first transistor and a gate of the second transistor are connected to same respective scan line.

8. The liquid crystal display device according to claim 1, wherein the one or more voltages are two voltages.

9. The liquid crystal display device according to claim 1, wherein the one or more voltages are more than two voltages.

10. The liquid crystal display device according to claim 1, wherein the common connection line drive circuit applies the one or more voltages to the common connection line sequentially in the holding period.

11. The liquid crystal display device according to claim 1, wherein each liquid crystal element includes a pixel electrode and a common electrode.

* * * * *